US006822620B2

(12) United States Patent
Watada et al.

(10) Patent No.: US 6,822,620 B2
(45) Date of Patent: Nov. 23, 2004

(54) HELICAL ANTENNA AND COMMUNICATION APPARATUS

(75) Inventors: Kazuo Watada, Kyoto (JP); Shunichi Murakawa, Kyoto (JP); Hiroshi Yoshizaki, Kyoto (JP); Akinori Sato, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/388,388

(22) Filed: Mar. 13, 2003

(65) Prior Publication Data

US 2003/0179152 A1 Sep. 25, 2003

(30) Foreign Application Priority Data

Mar. 14, 2002 (JP) ..... P2002-69394

(51) Int. Cl.[7] ..... H01Q 1/36; H01Q 1/38; H01Q 1/40

(52) U.S. Cl. ..... 343/895; 343/873; 343/787; 343/702

(58) Field of Search ..... 343/895, 873, 343/787, 702, 700 MS, 806; H01Q 1/36, 1/40, 1/38

(56) References Cited

U.S. PATENT DOCUMENTS 5,903,242 A 5/1999 Tsuru et al. ..... 343/873
6,486,853 B2 * 11/2002 Yoshinomoto et al. ..... 343/895

FOREIGN PATENT DOCUMENTS

JP 09-12113 5/1997 ..... H01Q/11/08
JP 2001-217631 8/2001 ..... H01Q/1/38

* cited by examiner

*Primary Examiner*—Tan Ho
*Assistant Examiner*—Trinh Vo Dinh
(74) *Attorney, Agent, or Firm*—Hogan & Hartson LLP

(57) ABSTRACT

The helical antenna comprises a base body and a helically-configured conductor on a top surface of the base body, wherein base body's thickness a is given as $0.3 \leqq a \leqq 3$ (mm); length b is given as $5 \leqq b \leqq 20$ (mm); and relative dielectric constant $\epsilon r$ is given as $3 \leqq \epsilon r \leqq 30$, and conductor's winding number x is given as $3 \leqq x \leqq 16$ (turns), and its resonant frequency f and conductor width w satisfy formulae (1): $f=Ax+By+C$ (MHz) and (2): $w=Dx+E$ (mm), where y represents base body width and A through E represent constants determined according to the base body's thickness a, length b, and relative dielectric constant $\epsilon r$.

8 Claims, 18 Drawing Sheets

WINDING NUMBER - CONDUCTOR WIDTH
(BASE BODY WIDTH: 2.5 mm)

WINDING NUMBER - CONDUCTOR WIDTH
(BASE BODY WIDTH: 3 mm)

WINDING NUMBER - CONDUCTOR WIDTH
(BASE BODY WIDTH: 3.5 mm)

WINDING NUMBER - RESONANT FREQUENCY
(BASE BODY WIDTH: 2.5 mm)

WINDING NUMBER - RESONANT FREQUENCY
(BASE BODY WIDTH: 3 mm)

WINDING NUMBER - RESONANT FREQUENCY
(BASE BODY WIDTH: 3.5 mm)

WINDING NUMBER - RESONANT FREQUENCY
(BASE BODY WIDTH: 2.5 mm)

WINDING NUMBER - RESONANT FREQUENCY
(BASE BODY WIDTH: 3 mm)

WINDING NUMBER - RESONANT FREQUENCY
(BASE BODY WIDTH: 3.5 mm)

HELICAL ANTENNA AND COMMUNICATION APPARATUS

BACKGROUND OF THE INVENTION

1. Field of the Invention

The present invention relates to a compact helical antenna for use in a mobile communication terminal, a local area network (LAN), or the like, and also relates to a communication apparatus incorporating the same.

2. Description of the Related Art

FIG. 18 is a perspective view showing one example of an antenna and its mounting method employed in a conventional mobile communication terminal. As seen from the figure, in general, a whip antenna 21 is mounted in a casing 22 of the mobile communication terminal.

In recent years, in keeping with advancement of mobile communication technology and diversification of customer services, portable terminals have been coming into wide use. In consideration of carryability, the communication terminals have come to have an increasingly smaller casing. With this trend, miniaturization and weight reduction have been underway in components which are incorporated or mounted in the communication terminals. Contrary to this current situation, the conventional whip antenna 21 is so configured as to protrude from the casing 22. In order to achieve further miniaturization of terminals, there is a demand for a downsized and lightweight antenna which is designed not to jut from a casing.

To satisfy such requirements, as a compact antenna, a helical antenna has been under development that has a radiating electrode composed of a conductor taking on a helical structure.

FIG. 19 is a perspective view showing a helical antenna disclosed in Japanese Unexamined Patent Publication JP-A 9-121113 (1997). This helical antenna is constructed by arranging a helically-configured conductor 15 within a base body 11. The conductor 15 is connected, at a feeding end 17, to a connecting portion of a terminal electrode 12 disposed at one end face of the base body 11, and is wound in a spiral fashion in the direction of the length of the base body 11. In this way, by forming the conductor 15, acting as a radiating electrode, in a helical shape, miniaturization of the antenna can be achieved.

In such a helical antenna, its resonant frequency is determined in accordance with the number of winding of the helically-configured conductor (=conductor length); the width of the conductor; the size (thickness, length, and width) of the base body; and the relative dielectric constant.

However, the following problem arises. The helical antenna, which is downsized by helically configuring the conductor, is susceptible particularly to an increase of capacity in conductor patterns and an influence of electrical connection. As a result, the resonant frequency tends to be greatly affected by a variation in the width of the conductor.

For example, depending on the method for constructing the conductor of such a downsized helical antenna, there may occur a nearly 5% dimensional variation in the conductor width. In this case, even if the helical antenna is so designed as to obtain a desired resonant frequency, it is inevitable that a great, nearly 5% variation in the resonant frequency occurs due to the variation of the conductor width caused in course of manufacture.

SUMMARY OF THE INVENTION

The invention has been devised in view of the above stated problems with the conventional art, and accordingly one object of the invention is to provide a compact helical antenna in which, even if there is for example a 5% variation in the conductor width, a variation in the resonant frequency can be reduced to 1% or below.

Another object of the invention is to provide a communication apparatus which is excellent in antenna characteristics stability, and incorporates a compact helical antenna in which, even if there is for example a 5% variation in the conductor width, a variation in the resonant frequency can be reduced to 1% or below.

Note that, if the frequency variation is reduced to 1% or below, the helical antenna, when used in PDC (Personal Digital Cellular), PHS (Personal Handyphone System), Bluetooth, or other systems, succeeds in satisfying specific frequency standards thereof.

As a result of conducting extensive research and study on the conductor pattern—resonant frequency relationship as observed in a helical antenna, the inventors of the present application have found that the use of a helical antenna having a subsequently-described structure makes it possible to solve the above stated problems. Thereupon, the present invention is accomplished.

The invention provides a helical antenna comprising a base body made of a dielectric material or a magnetic material, and a helically-configured conductor formed at least either on a top surface of the base body or in an interior thereof, wherein, in the base body, a thickness a (mm) is kept in a range of $0.3 \leqq a \leqq 3$ (mm); a length b (mm) is kept in a range of $5 \leqq b \leqq 20$ (mm); and a relative dielectric constant $\epsilon r$ is kept in a range of $3 \leqq \epsilon r \leqq 30$ or a relative magnetic permeability $\mu r$ is kept in a range of $1 \leqq \mu r \leqq 8$, and also a number of winding x (turn) of the conductor is kept in a range of $3 \leqq x \leqq 16$, and wherein a resonant frequency f (MHz) and a width w (mm) of the conductor satisfy following formulae (1) and (2), respectively:

$$f = Ax + By + C\,(MHz) \tag{1}$$

$$w = Dx + E\ (mm) \tag{2}$$

where y represents a width (mm) of the base body; and

A, B, C, D, and E each represent a constant which is determined in accordance with the thickness a, the length b, and the relative dielectric constant $\epsilon r$ or the relative magnetic permeability $\mu r$ of the base body.

According to the invention, in correspondence with the thickness, length, and relative dielectric constant of the base body and the number of winding of the conductor under predetermined conditions, the resonant frequency and the width of the conductor are each so set as to satisfy the predetermined formula. In this way, a helical antenna having a desired resonant frequency can be designed with ease in accordance with the formulae. Moreover, although the relationship between the width of the helically-configured conductor and the resonant frequency has not been theoretically clarified yet, if the radiating electrode is fabricated from the helically-configured conductor having a width which is so set as to satisfy the formula, the resultant relationship can be such that the resonant frequency is affected little by a variation in the conductor width. Thus, even if there is for example a 5% variation in the conductor width, a variation in the resonant frequency can be reduced to 1% or below with respect to the designed resonant frequency.

According to the invention, it is possible to realize a compact helical antenna having desired antenna characteristics, with which its resonant frequency, conductor width, and base body width can be designed with ease. It is also possible to provide a helical antenna in which, even if a variation occurs in the conductor width in course of manufacture, a variation in the targeted resonant frequency can be suppressed to the level where no problem arises in practical use.

The invention also provides a communication apparatus comprising the helical antenna according to the invention as described above.

Specifically, the invention provides a communication apparatus comprising a helical antenna including a base body made of a dielectric material or a magnetic material, and a helically-configured conductor formed at least either on a top surface of the base body or in an interior thereof, wherein, in the base body of the helical antenna, a thickness a (mm) is kept in a range of $0.3 \leqq a \leqq 3$ (mm); a length b (mm) is kept in a range of $5 \leqq b \leqq 20$ (mm); and a relative dielectric constant $\epsilon r$ is kept in a range of $3 \leqq \epsilon r \leqq 30$ or a relative magnetic permeability $\mu r$ is kept in a range of $1 \leqq \mu r \leqq 8$, and also a number of winding x (turn) of the conductor is kept in a range of $3 \leqq x \leqq 16$, and wherein a resonant frequency f (MHz) and a width w (mm) of the conductor satisfy following formulae (1) and (2), respectively:

$$f = Ax + By + C (MHz) \quad (1)$$

$$w = Dx + E \ (mm) \quad (2)$$

where y represents a width (mm) of the base body; and

A, B, C, D, and E each represent a constant which is determined in accordance with the thickness a, the length b, and the relative dielectric constant $\epsilon r$ or the relative magnetic permeability $\mu r$ of the base body.

According to the invention, even if there is for example a 5% variation in the conductor width of the helical antenna, a variation in the resonant frequency can be reduced to 1% or below with respect to the designed resonant frequency. Thus, it is possible to realize a communication apparatus incorporating a downsized helical antenna that is excellent in antenna characteristics stability.

In the invention, it is preferable that the base body is made of alumina ceramics or forsterite ceramics.

In the invention, it is preferable that the base body is made of tetrafluoroethylene or glass epoxy.

In the invention, it is preferable that the base body is made of YIG (Yttrium Iron Garnet), Ni—Zr compound or Ni—Co—Fe compound.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
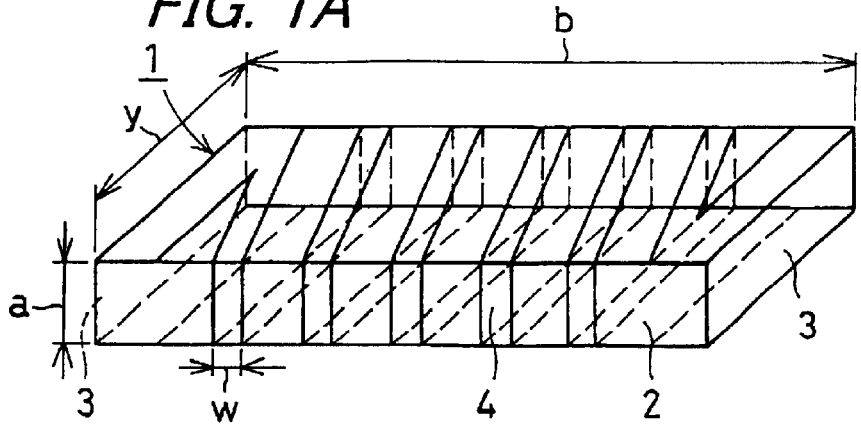
FIGS. 1A through 1C is a perspective view showing one example of a helical antenna of an embodiment according to the invention.

Now referring to the drawings, preferred embodiments of the invention are described below.

Hereafter, the invention will be described by way of embodiments with reference to the accompanying drawings.

Figure 1B:
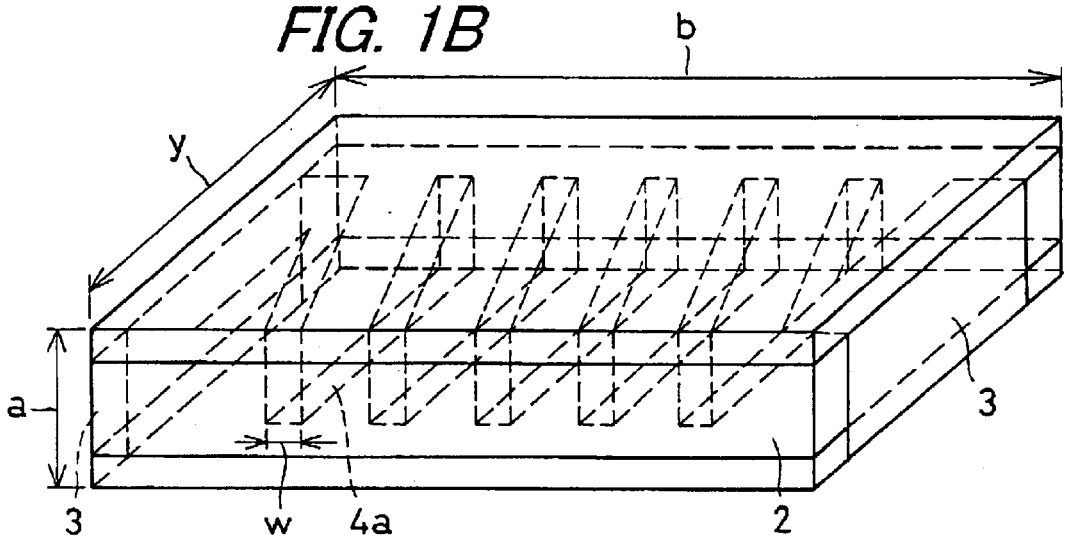
Figure 1C:
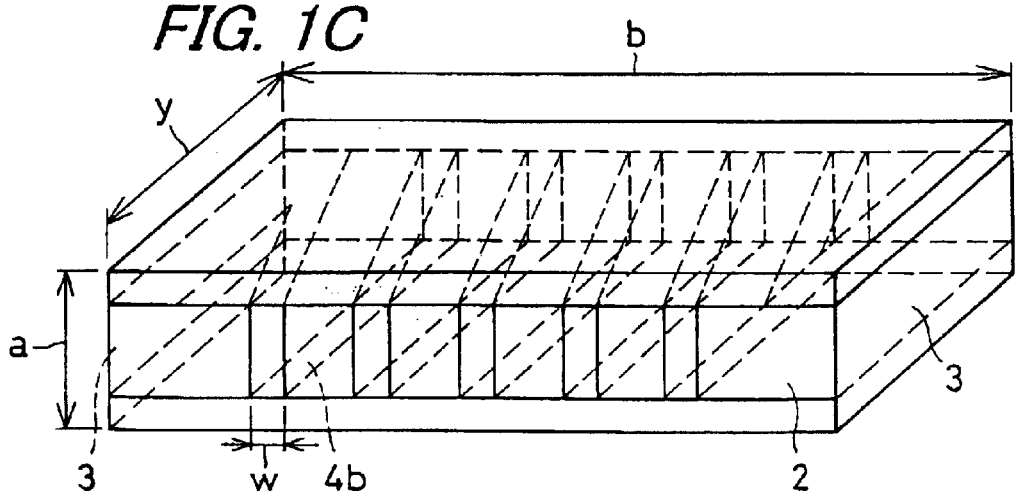

FIGS. 1A to 1C are a perspective view showing one example of embodiments of a helical antenna according to the invention. In FIG. 1A, the helical antenna 1 embodying the invention includes a base body 2; a feeding terminal 3 which is disposed on the end face of the base body 2 and a helically-configured conductor 4 which is formed on the top surface of the base body 2.

The helical antenna 1 shown in the figure, which is designed for use in mobile communications, a LAN, or the like systems, is constructed as follows. On the top surface of the base body 2 of substantially parallelepiped shape, which is made of ceramics for example, there are arranged the linear conductor 4 and the feeding terminal 3. The conductor 4 is helically configured in the direction of the length of the base body 2. The feeding terminal 3 serves to feed a high-frequency signal power to the conductor 4.

Note that, in the construction of this example, the conductor 4 is formed on the top surface of the base body 2. In this case, the formation of the conductor 4 is easy and the helical antenna 1 can be produced without employing a lamination method, whereby making it possible to reduce the manufacturing cost.

Alternatively, the conductor 4*a* may be formed within the base body 2 as shown in FIG. 1B. In this case, for example, in part of the base body 2 that is located inside and outside of the conductor 4*a*, the relative dielectric constant of the dielectric material, or the relative magnetic permeability of the magnetic material can be set arbitrarily. This can help facilitate an adjustment to the antenna characteristics. Moreover, the conductor 4*a* is formed so as not to be exposed on the top surface of the base body 2. Therefore, even if a dielectric material is arranged around the antenna, an influence exerted by the dielectric material can be sufficiently suppressed.

Further, as shown in FIG. 1C, the conductor 4*b* may be formed both on the top surface and in the interior of the base body 2. In this case, the surroundings of the conductor 4*b* (relative dielectric constant, etc.) vary depending on whether it is located on the top surface or in the interior. By varying combination of the formed positions of the conductor 4*b*, a part of the conductor 4*b* is formed in the interior of the base body 2 so that the influence exerted by the dielectric material around the antenna is sufficiently suppressed, and a part of the conductor 4*b* is formed on the top surface of the base body 2 so that the part thereof is trimmed and thereby it is possible to easily adjust the frequency and to attain a plurality of antennas having different antenna characteristics based on a single helical antenna 1 alone.

The base body 2 is made of a dielectric material or a magnetic material. For example, there is prepared a dielectric material which is predominantly composed of alumina (relative dielectric constant: 9.6). Such a material in powder form is subjected to pressure-molding and firing to form ceramics. Using this ceramics, the base body 2 is commonly constituted in a substantially parallelepiped shape. Alternatively, the base body 2 may be composed of a composite material made of ceramics, i.e. a dielectric material and resin, or a magnetic material such as ferrite.

In a case where the base body 2 is composed of a dielectric material, a high frequency signal propagates through the conductor 4 at a lower speed, resulting in the wavelength becoming shorter. When the relative dielectric constant of the base body 2 is expressed as $\epsilon r$, the effective length of a pattern of the conductor 4 is given as $1/\epsilon r^{1/2}$, that is, the effective length is decreased. Hence, if the pattern length is kept the same, when the frequency is adjusted in such a manner that the pattern width is changed and the frequency becomes the same, the current distribution region is increased in area. This allows the conductor 4 to emit a larger quantity of radio waves, resulting in an advantage in enhancing the gain of the antenna.

By contrast, in the case of attaining the same antenna characteristics as conventional ones, the pattern length of the conductor 4 can be set at $1/\epsilon r^{1/2}$. Thus, miniaturization of the helical antenna 1 can be achieved.

Note that fabricating the base body 2 from a dielectric material creates the following tendencies. If the value $\epsilon r$ is less than 3, it approaches the relative dielectric constant observed in the air ($\epsilon r=1$). This makes it difficult, for the foregoing reason, to meet the demand of the market for antenna miniaturization. By contrast, if the value $\epsilon r$ exceeds 30, although miniaturization can be achieved, since the gain and the bandwidth of the antenna are proportional to the size of the antenna, the gain and the bandwidth of the antenna are sharply decreased. As a result, the antenna fails to provide satisfactory antenna characteristics. Hence, in the case of fabricating the base body 2 from a dielectric material, it is preferable to use a dielectric material having a relative dielectric constant $\epsilon r$ which is kept within a range from 3 to 30. The examples of such a dielectric material include ceramic materials such as alumina ceramics, forsterite ceramics, zirconia ceramics or the like, or resin materials such as tetrafluoroethylene, glass epoxy or the like.

On the other hand, in the case of fabricating the base body 2 from a magnetic material, the conductor 4 has a higher impedance. This results in a low Q factor in the antenna, and the bandwidth is accordingly increased.

Fabricating the base body 2 from a magnetic material creates the following tendency. If the relative magnetic permeability $\epsilon r$ exceeds 8, although a wider bandwidth can be achieved in the antenna, since the gain and the bandwidth of the antenna are proportional to the size of the antenna, the gain and the bandwidth of the antenna are sharply decreased. As a result, the antenna fails to provide satisfactory antenna characteristics. Hence, in the case of fabricating the base body 2 from a magnetic material, it is preferable to use a magnetic material having a relative magnetic permeability $\mu r$ which is kept within a range from 1 to 8. The examples of such a magnetic material include YIG (Yttrium Iron Garnet), Ni—Zr compound, or Ni—Co—Fe compound.

The helically-configured conductor 4 and the feeding terminal 3, for constituting the radiating electrode pattern of the helical antenna 1, are each made of for example a metal material which is predominantly composed of any of aluminum, copper, nickel, silver, palladium, platinum, and gold. In order to form various patterns with the aforementioned metal materials, conductor layers having desired pattern configurations are formed by using a conventionally-known printing method, a thin-film forming technique based on a vapor-deposition method, a sputtering method, etc., a metal foil bonding method, a plating method, or the like.

So long as the size (thickness a and length b) of the base body 2, as shown also in FIG. 1A, and the relative dielectric constant $\epsilon r$ (or the relative magnetic permeability $\mu r$) are each set in the predetermined range, the resonant frequency f of the helical antenna 1 is correlated with the number of winding x of the conductor 4 and the width y of the base body 2. Based on this fact, examination and study were conducted as to the relationship between the resonant frequency f and the number of winding x of the conductor 4 and the width y of the base body 2, as observed when the thickness a, length b, and relative dielectric constant $\epsilon r$ of the base body 2, and the number of winding of the helically-configured conductor 4 are each set in the predetermined range. As a result, it has been found that a helical antenna having desired antenna characteristics can be realized by setting the resonant frequency f and the width w of the conductor 4 in accordance with the following formulae.

Specifically, if it is assumed that, in the base body 2, the thickness a (mm) is kept in a range of $0.3 \leqq a \leqq 3$ (mm), the length b (mm) is kept in a range of $5 \leqq b \leqq 20$ (mm), and the relative dielectric constant $\epsilon r$ is kept in a range of $3 \leqq \epsilon r \leqq 30$ or the relative magnetic permeability $\mu r$ is kept in a range of $1 \leqq \mu r \leqq 8$ and that the number of winding x (turns) of the helically-configured conductor 4 is kept in a range of $3 \leqq x \leqq 16$, then the resonant frequency f (MHz) of the helical antenna 1 satisfies the following formulae (1).

$$f = Ax + By + C (MHz) \quad (1)$$

where y represents the width (mm) of the base body 2; and

A, B, and C each represent a constant which is determined in accordance with the thickness a, the length b, and the relative dielectric constant $\epsilon r$ or the relative magnetic permeability $\mu r$ of the base body 2.

The above formula (1) was determined by pursuing the following procedure. FIGS. 3A to 3D are charts each showing a variation in the relationship between the width w of the helically-configured conductor 4 and the resonant frequency f (the conductor width—resonant frequency relationship), as observed when the number of winding of the conductor 4 is changed on the basis of the width y of the base body 2. In each chart of FIGS. 3A to 3D, the width w of the conductor 4 (unit: mm) is taken along the horizontal axis, and the resonant frequency f (unit: MHz) is taken along the vertical axis. Besides, characteristic curves and plots each represent a variation in the resonant frequency f with respect to the width w of the conductor 4, as observed when the number of winding x of the conductor 4 (unit: turns) is changed. In this example, the width y of the base body 2 takes four different values: 2.5 mm, 2.8 mm, 3 mm, and 3.2 mm, and the number of winding x of the conductor 4 takes four different values: 9, 10, 11, and 12, or three different values: 10, 11, and 12. The width w of the conductor 4 is varied within a range from 0.2 to 0.6 mm. Moreover, the conditions to be fulfilled by the base body 2 are that the thickness a is 0.5 mm; the length b is 10 mm; and the relative dielectric constant $\epsilon r$ is 9.6. As will be understood from these charts, with respect to each of the winding numbers x of the conductor 4, there is a point where the variation of the resonant frequency f corresponding to the variation of the width w of the conductor 4 is particularly slight (the vertex of the convexly-curved characteristic curve).

Next, the points where the variation of the resonant frequency f is slight are extracted and shown in the charts of FIGS. 4A to 4D. In these figures, the number of winding x of the conductor 4 is taken along the horizontal axis, and the resonant frequency f is taken along the vertical axis. Thereupon, the relationship between the number of winding and the resonant frequency is plotted on a base body 2 width basis. As seen from the figures, each of the characteristic curves is defined by a straight-line segment, and the approximation equations corresponding to the individual straight-line segments are substantially equal to one another in inclination. Thus, the resonant frequency f is proportional to the number of winding x of the conductor 4. Thereafter, the equation: f=Ax+By+C is derived on the assumption that there is a proportionality between the width y of the base body 2 (unit: mm) and the resonant frequency f. By substituting the conditions indicated in FIGS. 4A to 4D into the equation, solutions to the simultaneous equations are obtained, and thereby the constants A, B, and C are determined. As a result of examining the availability of the equation under the other conditions as to the base body, the equation has proved to hold under any of the conditions. Thus, the formula (1) is obtained.

Incidentally, so long as the thickness a and the length b of the base body 2 are each set in the predetermined range, the width w of the conductor 4 corresponding to the desired resonant frequency f can be obtained by being correlated with the number of winding x of the conductor 4. This is because, at the time when the ratio of the width W of the conductor 4 to the distance (interval) between the conductor 4 portions reaches a certain level, the width w of the conductor 4 has a minimal effect on the resonant frequency f.

Based on this finding, examination was conducted on the formula representing the relationship between the width w of the conductor 4 and the number of winding x of the conductor 4. As a result, as described previously, given that, in the base body 2, the thickness a (mm) is kept in a range of $0.3 \leqq a \leqq 3$ (mm), the length b (mm) is kept in a range of $5 \leqq b \leqq 20$ (mm), and the relative dielectric constant $\epsilon r$ is kept in a range of $3 \leqq \epsilon r \leqq 30$ or the relative magnetic permeability $\mu r$ is kept in a range of $1 \leqq \mu r \leqq 8$; and that the number of winding x (turns) of the helically-configured conductor 4 is kept in a range of $3 \leqq x \leqq 16$, then the following formula holds.

$$w = Dx + E \ (mm) \quad (2)$$

where

D and E each represent a constant which is determined in accordance with the thickness a, the length b, and the relative dielectric constant $\epsilon r$ or the relative magnetic permeability $\mu r$ of the base body 2.

The above formula (2) was determined by pursuing the following procedure. Based on the conductor width—resonant frequency relationship shown in FIGS. 5A to 5D, the width w of the conductor 4, as observed when the variation of the resonant frequency f is kept minimum, is obtained by means of approximation equations. The calculation results are shown in the charts of FIGS. 5A to 5D. In these figures, the number of winding x of the conductor 4 is taken along the horizontal axis, and the width w of the conductor 4 is taken along the vertical axis. Thereupon, the winding number—conductor width relationship is plotted on a base body 2 width basis. As seen from the figures, each of the characteristic curves is defined by a straight-line segment, and the approximation equations corresponding to the individual straight-line segments are substantially equal to one another. Consequently, it has been found that the width w of the conductor 4 is proportional to the number of winding x of the conductor 4, but has little correlation to the width y of the base body 2. By drawing the relationship between the winding number of the conductor 4 and the conductor width w in that way, the constants D and E can be determined, and thus the formula (2) holds.

In the helical antenna 1 embodying the invention, the conditions that should be fulfilled to satisfy the formula (2) are as follows: the thickness a of the base body 2 is kept in a range of $0.3 \leqq a \leqq 3$ (mm); the length b of the base body 2 is kept in a range of $5 \leqq b \leqq 20$ (mm); the relative dielectric constant $\epsilon r$ of the base body 2 is kept in a range of $3 \leqq \epsilon r \leqq 30$ or the relative magnetic permeability $\mu r$ of the base body 2 is kept in a range of $1 \leqq \mu r \leqq 8$; and the number of winding x of the conductor 4 is kept in a range of $3 \leqq x \leqq 16$ (turns). So long as the above conditions are fulfilled, the constants D and E can be obtained based on the thickness a, the length b, and the relative dielectric constant $\epsilon r$ or the relative magnetic permeability $\mu r$ of the base body 2.

Note that, if the number of winding x of the conductor 4 is less than 3 (turns), the antenna finds application in a high-frequency region. This requires the conductor 4 be originally made shorter in length, and thus cancels out the advantage of miniaturization brought about by the helical structure. By contrast, if the number of winding x of the conductor 4 exceeds 17 (turns), the distance (interval) between the conductor 4 portions is decreased, with the result that the adjacent conductor 4 portions interfere with each other. This makes it impossible to shorten the electrical length sufficiently, resulting in difficulty in downsizing the antenna.

If the thickness a of the base body 2 is less than 0.3 mm, the strength of the antenna is so low that the antenna cannot be operated under certain usage conditions for a terminal or other equipment. By contrast, if the thickness a of the base body 2 exceeds 3 mm, the advantage of miniaturization brought about by the helical structure is cancelled out.

Moreover, if the length b of the base body 2 is less than 5 mm, the antenna characteristics are deteriorated, particularly the bandwidth becomes narrow and the gain is decreased, with the result that the antenna fails to satisfy the necessary requirements. By contrast, if the length b of the base body 2 exceeds 20 mm, the advantage of miniaturization brought about by the helical structure is canceled out.

Further, if the relative dielectric constant $\epsilon r$ of the base body 2 is less than 3, as described earlier, it approaches the relative dielectric constant observed in the air ($\epsilon r \cdot 1$), which makes miniaturization of the antenna difficult. By contrast, if the relative dielectric constant $\epsilon r$ of the base body 2 exceeds 30, the antenna characteristics are deteriorated and the bandwidth and the gain are decreased, with the result that the antenna fails to satisfy the necessary requirements.

In the helical antenna embodying the invention, a fine adjustment to the resonant frequency f, which is obtained from the formula (1), can be made by adjusting the width y of the base body 2 in the formula (1). As will be understood from the formula (1), the resonant frequency f can also be adjusted by changing the number of winding x of the conductor 4. In this case, however, since the number of winding x of the conductor 4 can basically take on integral values alone, the resonant frequency f can be adjusted only on a ca. 100 MHz basis. Meanwhile, the value of the width y of the base body 2 can be adjusted according to the dimensional accuracy for the base body 2 in terms of production capability (in general, adjustment is made on a ca. 10 $\mu$m basis). Thus, in the case of adjusting the width y of the base body 2, the resonant frequency f can be adjusted on a ca. 2 to 3 MHz basis. In addition to that, since the number of winding x of the conductor 4 remains unchanged at this time, the line width w of the conductor 4 also remains unchanged as a matter of course. That is, since the ratio of the line width w of the conductor 4 to the line-to-line interval of the conductor 4 remains unchanged, in the helical antenna 1, the resonant frequency f is affected little by the variation of the width w of the conductor 4. Hence, by adjusting the width y of the base body 2, the resonant frequency f can be fine-adjusted with high accuracy.

Note that, in the helical antenna 1 embodying the invention, in order to set the resonant frequency f and the width w of the conductor 4 properly in the above-described way, instead of exploiting the width y of the base body 2, it is also possible to exploit the thickness a of the base body 2 (unit: mm). In this case, the constants A, B, C, D, and E found in the formulae (1) and (2) must be determined afresh basically in the same manner as in the above-described example of the embodiment of the helical antenna 1 according to the invention.

Also in this case, to satisfy the formulae (1) and (2), the following conditions must be fulfilled: the number of winding x of the conductor 4 is kept in a range of $3 \leqq x \leqq 16$ (turns); the thickness a of the base body 2 is kept in a range of $0.3 \leqq a \leqq 3$ (mm); the length b of the base body 2 is kept in a range of $5 \leqq b \leqq 20$ (mm); and the relative dielectric constant $\epsilon r$ of the base body 2 is kept in a range of $3 \leqq \epsilon r \leqq 30$. So long as such dimensional values are fixed, the constants A, B, C, D, and E found in the formulae (1) and (2) can be determined just as in the case of the example of the above embodiment. Thus, the desired resonant frequency f and the width w of the conductor 4 can be designed by means of equations.

Figure 2:
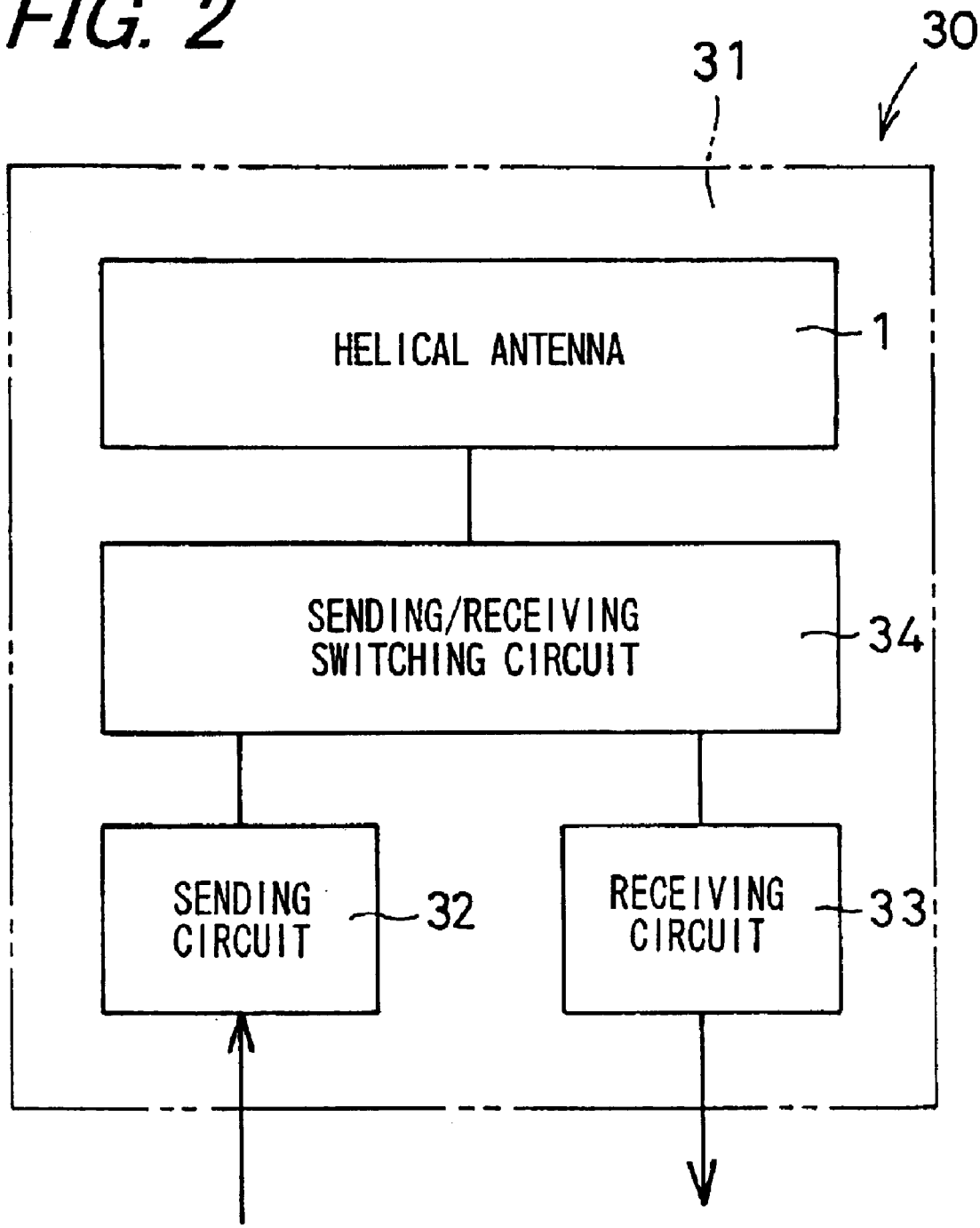
FIG. 2 is a simplified block diagram of an electrical configure of a main port of a communication apparatus comprising the helical antenna of the embodiment according to the invention.
Figure 3A:
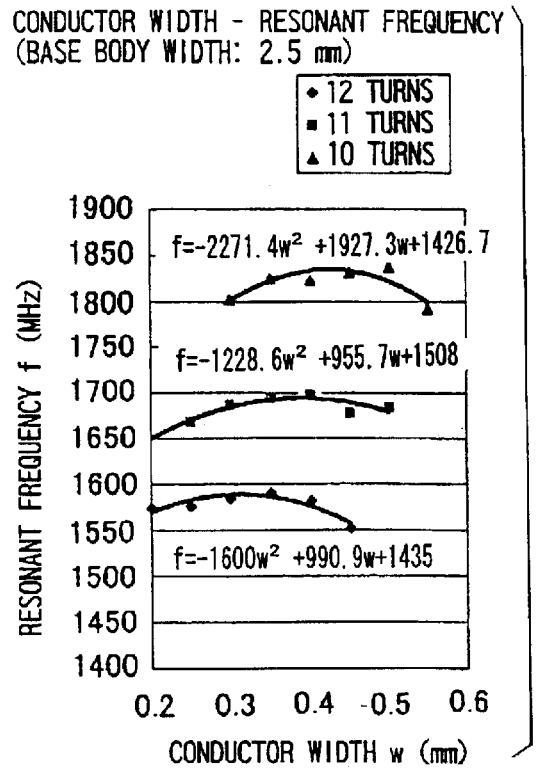
FIGS. 3A through 3D are charts each showing the conductor width—resonant frequency relationship as observed in the helical antenna, on a base body width basis.
Figure 3B:
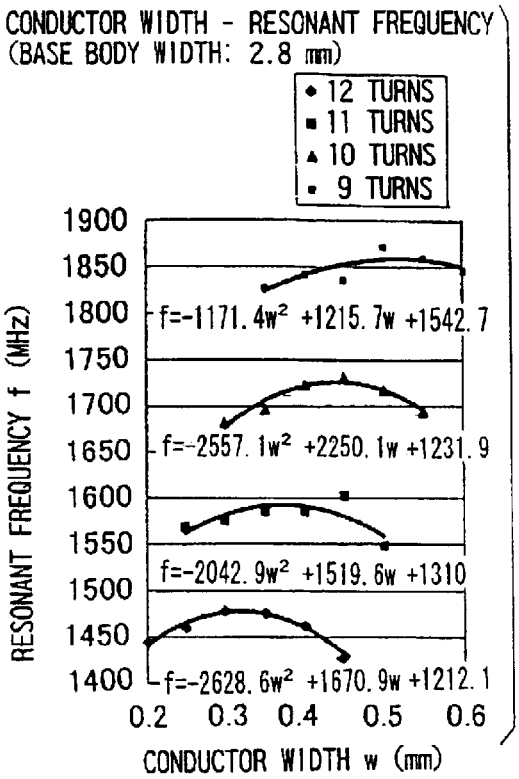
Figure 3C:
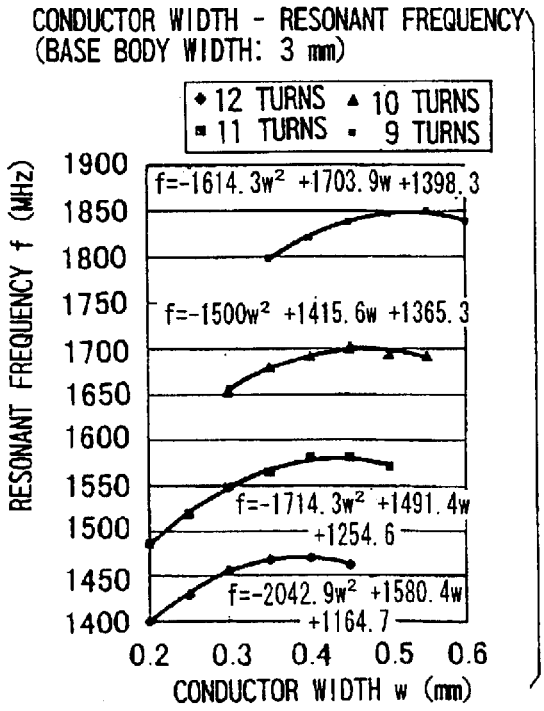
Figure 3D:
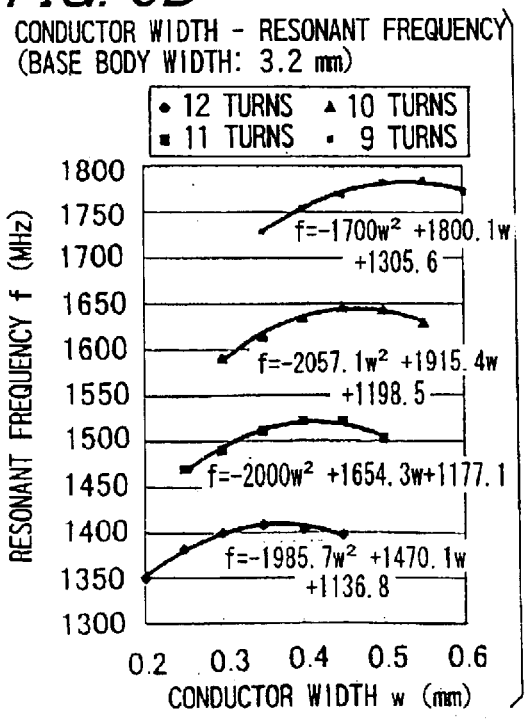
Figure 4A:
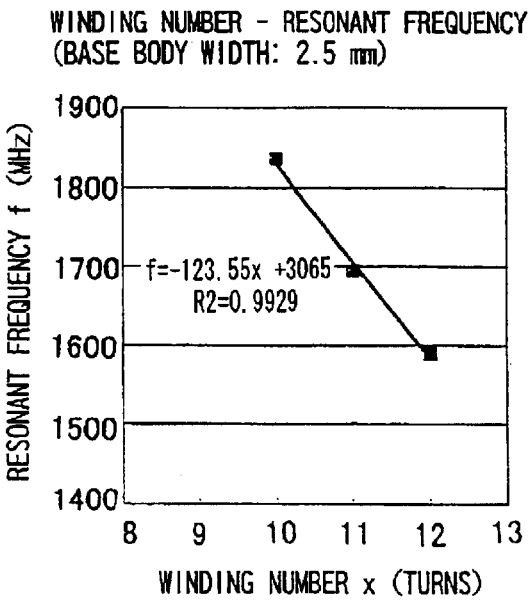
FIGS. 4A through 4D are charts each showing the conductor winding number—resonant frequency relationship as observed in the helical antenna, on a base body width basis.
Figure 4B:
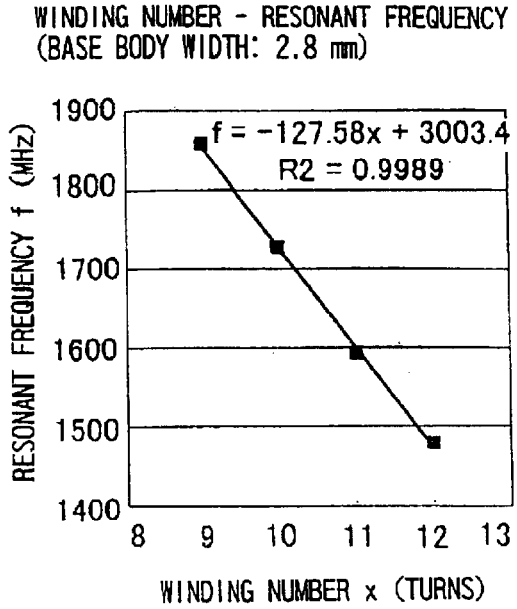
Figure 4C:
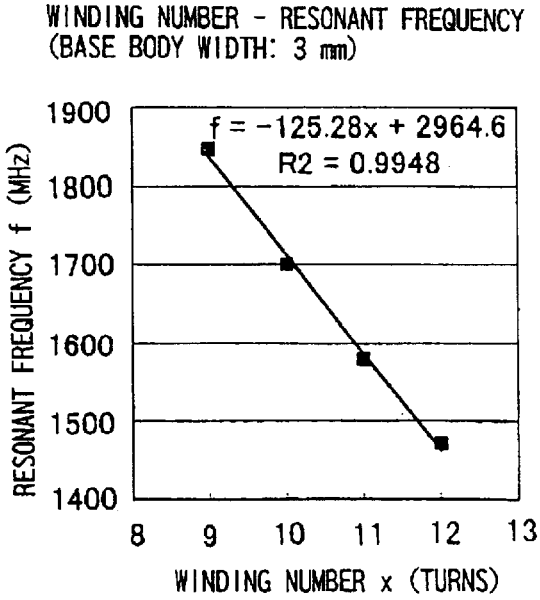
Figure 4D:
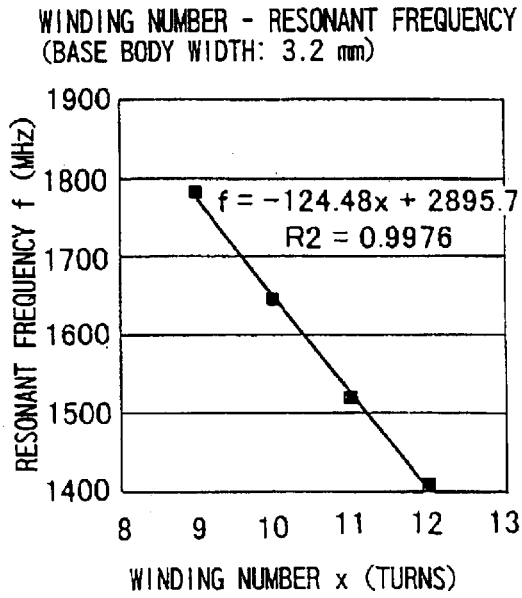
Figure 5A:
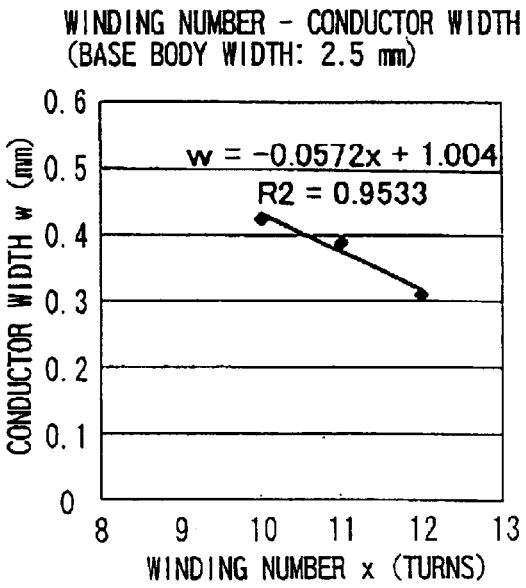
FIGS. 5A through 5D are charts each showing the conductor winding number—conductor width relationship as observed in the helical antenna, on a base body width basis.
Figure 5B:
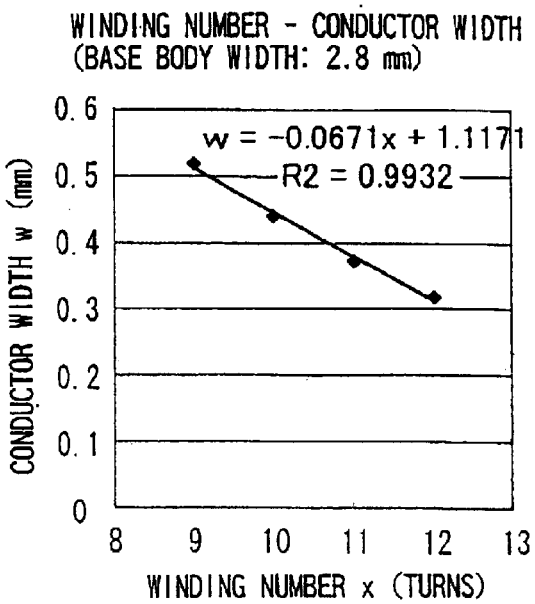
Figure 5C:
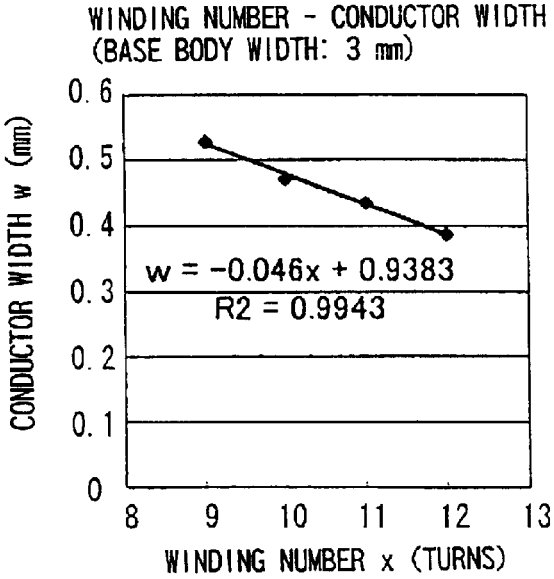
Figure 5D:
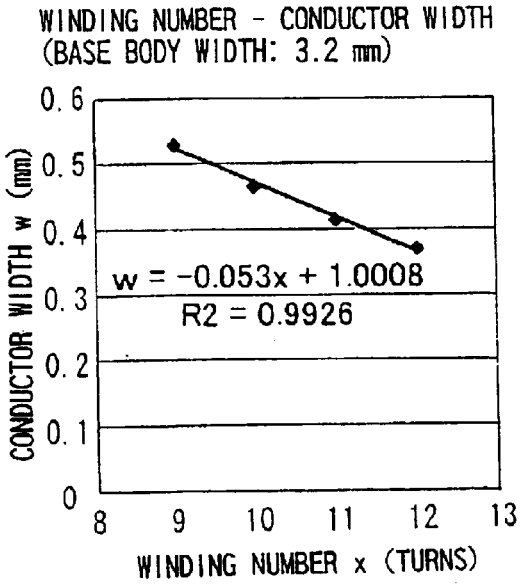

Subsequently, a description will be given below as to one example of an embodiment of the communication apparatus 30 according to the invention. FIG. 2 is a simplified block diagram of an electrical configure of a main port of the communication apparatus 30 incorporating a helical antenna of the embodiment according to the invention. The communication apparatus 30 embodying the invention is built as a communication apparatus equipped with the above-described helical antenna of the invention. This is designed for use as a data communication apparatus in a mobile communication terminal, typified by a cellular mobile phone, a wireless LAN, or the like systems.

For example, a cellular mobile phone incorporates, in its casing, a circuit board 31 for communication circuits. In general, on the circuit board 31 are formed a sending circuit 32, a receiving circuit 33, and a sending/receiving switching circuit 34. The sending circuit 32 is electrically connected to the sending/receiving switching circuit 34. The receiving circuit 33 is electrically connected to the sending/receiving switching circuit 34. Moreover, on the circuit board 31 is surface-mounted the helical antenna 1 of the invention that is electrically connected, via the sending/receiving switching circuit 34, to the sending circuit 32 and receiving circuit 33. According to this cellular mobile phone, by the switching operation of the sending/receiving switching circuit 34, a sending operation, which is effected by feeding a sending signal to the helical antenna 1 from the receiving circuit 33, as well as a receiving operation, which is effected by feeding a receiving signal from the helical antenna 1 to the receiving circuit 33, can be executed smoothly, thereby achieving telephone communications.

According to the invention, the communication apparatus incorporates the above-described helical antenna of the invention. Therefore, even if for example a 5% variation occurs in the width of the helically-configured conductor due to dimensional deviation caused in the antenna in course of manufacture, a resultant variation in the resonant frequency can be reduced to 1% or below with respect to the designed value of the resonant frequency of the antenna. Thus, it is possible to provide a communication apparatus which is excellent in antenna characteristics and ensures stable communication quality.

EXAMPLES

Next, practical examples of the helical antenna embodying the invention will be described below.

Example 1

At first, as the base body of the helical antenna, there is prepared a substantially parallelepiped-shaped substrate made of alumina ceramics, which has a thickness a of 0.5 mm and a length b of 10 mm, with a relative dielectric constant $\epsilon r$ of 9.6. With respect to a surface of this substrate, test samples of the helical antenna varying in substrate width, conductor width, and conductor's winding number are fabricated. More specifically, the width y of the substrate is varied within a range from 2.5 mm to 3.2 mm; the width w of the helically-configured conductor is varied within a range from 0.2 mm to 0.6 mm; and the number of winding x of the conductor is varied within a range from 9 to 12 turns. Then, the resonant frequency f of each helical antenna sample was measured.

Note that measurement of the resonant frequency f is carried out as follows. Firstly, there is prepared a glass epoxy plate material which is 60 mm×25 mm×0.8 mm in size. The plate material has a ground conductor surface formed on one side, and has a strip line formed on the other side. In this substrate, the feeding terminal of each helical antenna sample is fixed to the strip line disposed on the substrate by soldering, and a coaxial line is connected to the opposite end of the strip line to achieve feeding. Thence, the resonant frequency f of each helical antenna sample is measured by means of a network analyzer manufactured by Agilent technologies, Inc.

Based on the measurement results thus obtained, the relationship between the conductor width and the resonant frequency (the conductor width—resonant frequency relationship) is plotted on a base body width basis in FIGS. 3A to 3D. In accordance with the approximation equations shown in the charts, the vertices of the characteristic curves are obtained. With the data, the relationship between the winding number of the conductor and the resonant frequency (the winding number—resonant frequency relationship) is plotted on a base body width basis in FIGS. 4A to 4D, and the relationship between the winding number of the conductor and the width of the conductor (the winding number—conductor width relationship) is plotted on a base body width basis in FIGS. 5A to 5D.

Next, based on the results shown in FIGS. 4A to 4D, the average value of the inclination of each approximation equation is calculated to determine the constant A (=−125.22) in the formula (1). Then, under the conditions indicated in FIGS. 4A to 4D, the values of the resonant frequency f, the number of winding x of the conductor, and the conductor width w are each substituted into the formula (1): f=−125.22x+By+C, so as to obtain solutions to the simultaneous equations associated with the constants B and C. In FIGS. 5A to 5D, by calculating the mean value of the solutions, the constants B (=−242.62) and C (=3679.72) are obtained.

Moreover, based on the results shown in FIGS. 5A to 5D, the average value of the inclination of each approximation equation is calculated to determine the constant D (=−0.056) in the formula (2). Then, under the conditions indicated in FIGS. 5A to 5D, the value of the winding number x of the conductor is substituted into the formula (2): w=−0.056x+E. In FIGS. 5A to 5D, by calculating the mean value of the solutions, the constant E (=1.015) is obtained.

In this way, in the base body made of alumina ceramics, which is 0.5 mm in thickness a and 10 mm in length b, with a relative dielectric constant $\epsilon r$ of 9.6, the resonant frequency f and the width w of the helically-configured conductor are respectively determined as follows by means of the formulae (1) and (2).

$$f=-125.22x-242.62y+3679.71(MHz)$$

$$w=-0.056x+1.015(mm)$$

Listed below are Tables 1 and 2 each showing the calculation results obtained from the formulae (1) and (2) and actual measured data on the helical antenna samples.

TABLE 1

| No. | Number of winding (turns) | Base body width (mm) | Resonant frequency (MHz) | Actual measurement data (MHz) | Difference | Error (%) |
|---|---|---|---|---|---|---|
| 1 | 10 | 2.5 | 1821.0 | 1835.5 | −14.5 | −0.79 |
| 2 | 11 | 2.5 | 1695.7 | 1693.9 | 1.8 | 0.11 |
| 3 | 12 | 2.5 | 1570.5 | 1588.4 | −17.9 | −1.13 |
| 4 | 9 | 2.8 | 1873.4 | 1858.1 | 15.3 | 0.82 |
| 5 | 10 | 2.8 | 1748.2 | 1726.9 | 21.3 | 1.23 |
| 6 | 11 | 2.8 | 1623.0 | 1592.6 | 30.4 | 1.91 |
| 7 | 12 | 2.8 | 1497.7 | 1477.6 | 20.1 | 1.36 |
| 8 | 9 | 3.0 | 1824.9 | 1847.9 | −23.0 | −1.25 |
| 9 | 10 | 3.0 | 1699.7 | 1699.3 | 0.4 | 0.02 |
| 10 | 11 | 3.0 | 1574.4 | 1579 | −4.6 | −0.29 |
| 11 | 12 | 3.0 | 1449.2 | 1470.4 | −21.2 | −1.44 |
| 12 | 9 | 3.2 | 1776.3 | 1782.1 | −5.8 | −0.32 |
| 13 | 10 | 3.2 | 1651.1 | 1644.4 | 6.7 | 0.41 |
| 14 | 11 | 3.2 | 1525.9 | 1519.2 | 6.7 | 0.44 |
| 15 | 12 | 3.2 | 1400.7 | 1408.9 | −8.2 | −0.58 |

TABLE 2

| No. | Number of winding (turns) | Base body width (mm) | Conductor width (mm) | Actual measurement data (mm) | Difference | Error (%) |
|---|---|---|---|---|---|---|
| 1 | 10 | 2.5 | 0.455 | 0.424 | 0.031 | 7.26 |
| 2 | 11 | 2.5 | 0.399 | 0.389 | 0.010 | 2.60 |
| 3 | 12 | 2.5 | 0.343 | 0.310 | 0.033 | 10.75 |
| 4 | 9 | 2.8 | 0.511 | 0.519 | −0.008 | −1.52 |
| 5 | 10 | 2.8 | 0.455 | 0.440 | 0.015 | 3.41 |
| 6 | 11 | 2.8 | 0.399 | 0.372 | 0.027 | 7.29 |
| 7 | 12 | 2.8 | 0.343 | 0.318 | 0.025 | 7.93 |
| 8 | 9 | 3.0 | 0.511 | 0.528 | −0.017 | −3.18 |
| 9 | 10 | 3.0 | 0.455 | 0.472 | −0.017 | −3.58 |
| 10 | 11 | 3.0 | 0.399 | 0.435 | −0.036 | −8.28 |
| 11 | 12 | 3.0 | 0.343 | 0.387 | −0.044 | −11.32 |
| 12 | 9 | 3.2 | 0.511 | 0.529 | −0.018 | −3.48 |
| 13 | 10 | 3.2 | 0.455 | 0.466 | −0.011 | −2.28 |
| 14 | 11 | 3.2 | 0.399 | 0.414 | −0.015 | −3.53 |
| 15 | 12 | 3.2 | 0.343 | 0.370 | −0.027 | −7.35 |

As will be understood from the results shown in Tables 1 and 2, according to the helical antenna embodying the invention, both of the value of the resonant frequency f and the value of the conductor width w, which are so determined as to satisfy the formulae (1) and (2), are roughly equal to their corresponding actually measured values. More specifically, the maximum error between the calculated resonant frequency f and the corresponding measured value is as small as 1.9%, and the maximum error between the calculated conductor width w and the corresponding measured value is as small as 11%. That is, the error between the calculated and measured values is considered as insignificant and thus has no influence on the helical antenna in practical use.

Moreover, listed below is Table 3 showing the variation of the resonant frequency f in each of the test samples of the helical antenna embodying the invention, as observed when a 5% fluctuation takes place in the value of the conductor width w obtained by means of the formulae (1) and (2).

TABLE 3

| No. | Number of winding (turns) | Base body width (mm) | Conductor width (mm) | Resonant frequency (MHz) | Conductor width + 5% | Resonant frequency (MHz) | Conductor width − 5% | Resonant frequency (MHz) | Maximum Error (%) |
|---|---|---|---|---|---|---|---|---|---|
| 1 | 10 | 2.5 | 0.455 | 1821.0 | 0.478 | 1816.6 | 0.432 | 1823.0 | 0.24 |
| 2 | 11 | 2.5 | 0.399 | 1695.7 | 0.419 | 1694.7 | 0.379 | 1695.7 | 0.06 |
| 3 | 12 | 2.5 | 0.343 | 1570.5 | 0.360 | 1568.2 | 0.326 | 1571.9 | 0.15 |
| 4 | 9 | 2.8 | 0.511 | 1873.4 | 0.537 | 1873.2 | 0.485 | 1872.2 | 0.06 |
| 5 | 10 | 2.8 | 0.455 | 1748.2 | 0.478 | 1745.1 | 0.432 | 1748.6 | 0.17 |
| 6 | 11 | 2.8 | 0.399 | 1623.0 | 0.419 | 1620.0 | 0.379 | 1624.4 | 0.18 |
| 7 | 12 | 2.8 | 0.343 | 1497.7 | 0.360 | 1496.6 | 0.326 | 1499.2 | 0.21 |
| 8 | 9 | 3.0 | 0.511 | 1824.9 | 0.537 | 1825.2 | 0.485 | 1822.4 | 0.13 |
| 9 | 10 | 3.0 | 0.455 | 1699.7 | 0.478 | 1700.0 | 0.432 | 1697.7 | 0.11 |
| 10 | 11 | 3.0 | 0.399 | 1574.4 | 0.419 | 1576.1 | 0.379 | 1571.2 | 0.20 |
| 11 | 12 | 3.0 | 0.343 | 1449.2 | 0.360 | 1451.7 | 0.326 | 1445.5 | 0.25 |
| 12 | 9 | 3.2 | 0.511 | 1776.3 | 0.537 | 1776.8 | 0.485 | 1773.6 | 0.15 |
| 13 | 10 | 3.2 | 0.455 | 1651.1 | 0.478 | 1651.1 | 0.432 | 1649.1 | 0.12 |
| 14 | 11 | 3.2 | 0.399 | 1525.9 | 0.419 | 1526.2 | 0.379 | 1523.9 | 0.13 |
| 15 | 12 | 3.2 | 0.343 | 1400.7 | 0.360 | 1402.0 | 0.326 | 1398.3 | 0.17 |

As will be understood from the results shown in Table 3, according to the helical antenna embodying the invention, even if there is a 5% variation in the conductor width w, the maximum variation of the resonant frequency f is reduced to as small as 0.25%. This figure is far less than 1%, i.e. a level where no problem arises in practical use.

Example 2

Basically in the same manner as in Example 1, the resonant frequency f and the conductor width w were obtained as follows in accordance with the following conditions as to the base body, with the drawings alike to FIGS. 3A to 3D, 4A to 4D and 5A to 5D, and the formulae (1) and (2). Here are some steps to follow:

1) fabricate a plurality of helical antenna samples varying in base body width y, conductor width w, and conductor winding number x, and then measure the resonant frequency f of each helical antenna;
2) based on the measurement data on the resonant frequency f thus obtained, plot the relationship between the conductor width w and the resonant frequency f on a base body width y basis and/or on a conductor winding number x basis, thereby creating characteristic curves, and then obtain approximation equations corresponding thereto;
3) based on the approximation equations corresponding to the characteristic curves, obtain the vertex of each characteristic curve, and therewith plot the relationship between the conductor winding number x and the resonant frequency f on a base body width y basis, thereby creating characteristic curves, and then obtain approximation equations corresponding thereto, and further determine the constant A by calculating the average value of the inclination of each approximation equation;
4) substitute the measured values of the constant A, the conductor winding number x, the base body width y, and the resonant frequency f into the formula (1), and solve the formula (1) so that the constants B and C are determined and the mean value is obtained;
5) meanwhile, based on the approximation equations corresponding to the characteristic curves, obtain the vertex of each characteristic curve, and therewith plot the relationship between the conductor winding number x and the conductor width w on a base body width y basis, thereby creating characteristic curves, and then obtain approximation equations corresponding thereto, and further determine the constant D by calculating the average value of the inclination of each approximation equation; and
6) substitute the values of the constant D and the conductor winding number x into the formula (2), and solve the formula (2) so that the constant E is determined and the mean value is obtained.

In the above stated manner, charts alike to FIGS. 3A to 3D, 4A to 4D, and 5A to 5D are depicted according to the following conditions. Moreover, the determined constants A, B, and C are substituted into the formula (1), whereas the determined constants D and E are substituted into the formula (2) so as to formulate equations representing the resonant frequency f and the conductor width w. Then, test samples of the helical antenna embodying the invention are fabricated that satisfy the calculated results obtained by the equations. For each helical antenna sample, the values of the resonant frequency f and the conductor width w are measured. The calculated results and the actual measurement data are presented in tables alike to Tables 1 to 3.

1) In the base body, given that the thickness a is 0.5 mm; the length b is 10 mm; and the relative dielectric constant $\epsilon r$ is 3, then the following equations hold:

$$f=-117.4x-284.3y+3782.9(MHz)$$

$$w=-0.047x+0.967(mm).$$

Figure 6A:
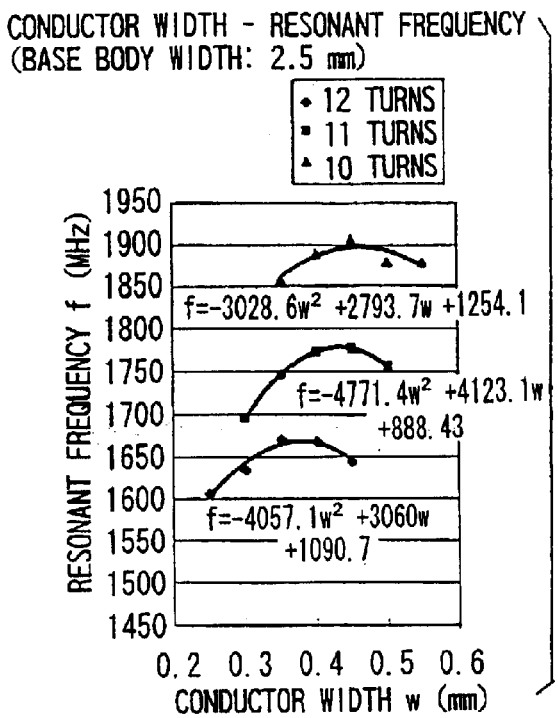
FIGS. 6A through 6C are charts each showing the conductor width—resonant frequency relationship as observed in the helical antenna, on a base body width basis.
Figure 6B:
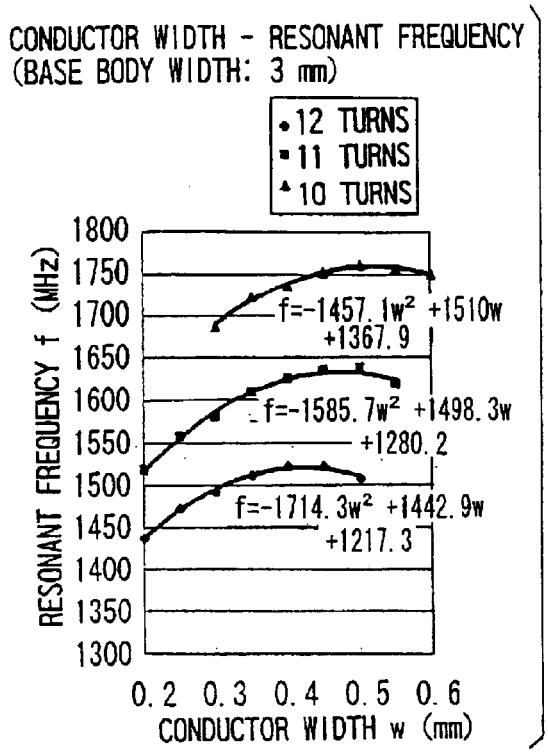
Figure 6C:
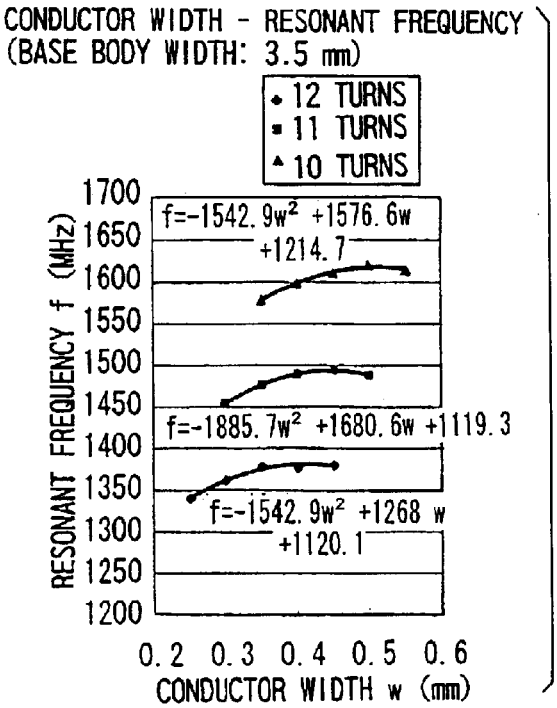
Figure 7A:
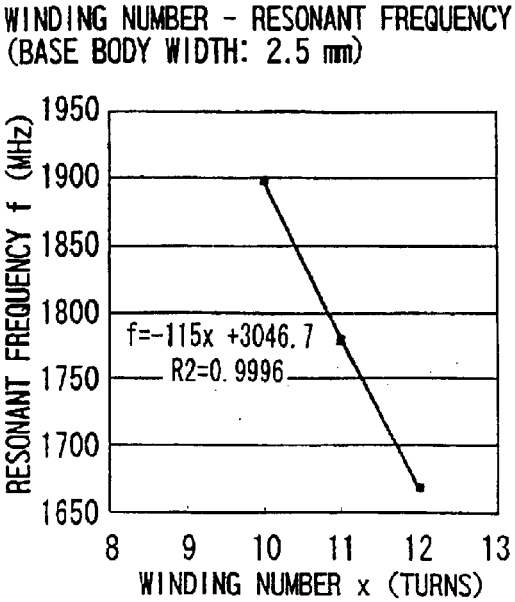
FIGS. 7A through 7C are charts each showing the conductor winding number—resonant frequency relationship as observed in the helical antenna, on a base body width basis.
Figure 7B:
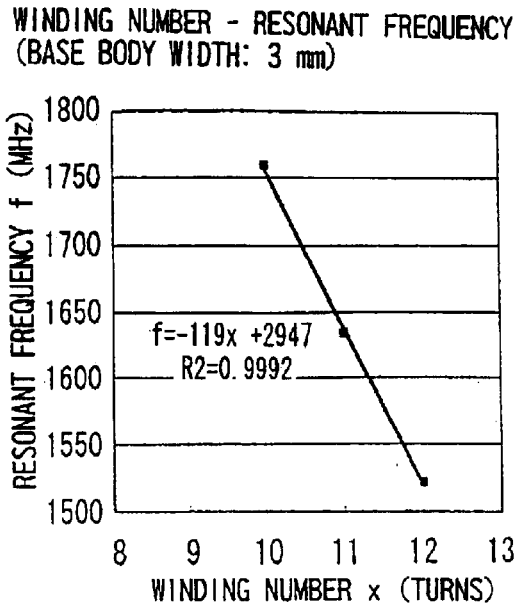
Figure 7C:
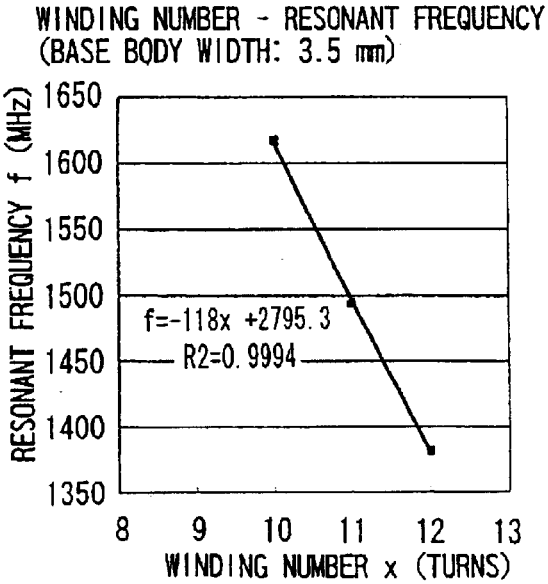
Figure 8A:
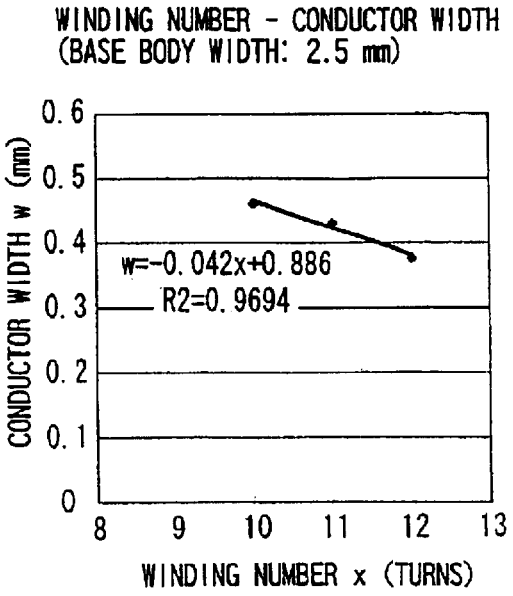
FIGS. 8A through 8C are charts each showing the conductor winding number—conductor width relationship as observed in the helical antenna, on a base body width basis.
Figure 8B:
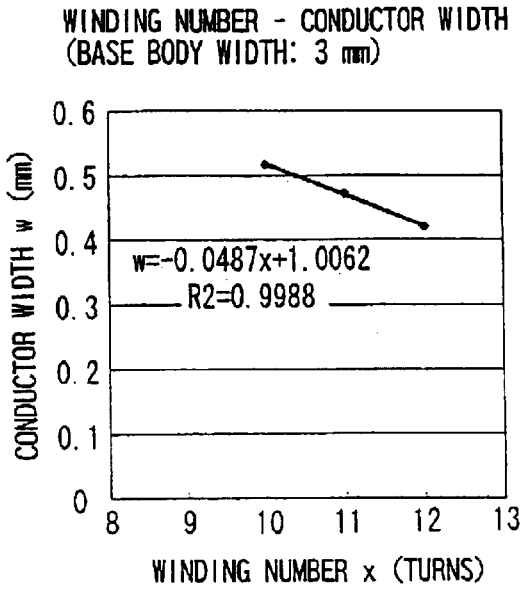
Figure 8C:
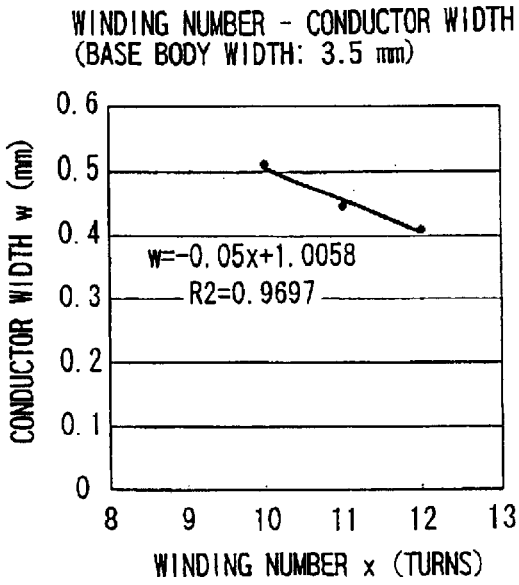

In this case, refer to FIGS. 6A to 6C (conductor width—resonant frequency relationship); FIGS. 7A to 7C (conductor winding number—resonant frequency relationship); and FIGS. 8A to 8C (conductor winding number—conductor width relationship), and in addition Table 4 (calculated results and actual measurement data on resonant frequency); Table 5 (calculated results and actual measurement data on conductor width); and Table 6 (variation of resonant frequency resulting from variation of conductor width).

TABLE 4

| No. | Number of winding x (turns) | Base body width y (mm) | Resonant frequency f (MHz) | Actual measurement data (MHz) | Difference | Error (%) |
|---|---|---|---|---|---|---|
| 16 | 10 | 2.5 | 1893.2 | 1898 | 0.2 | 0.01 |
| 17 | 11 | 2.5 | 1780.8 | 1779 | 1.8 | 0.10 |
| 18 | 12 | 2.5 | 1663.4 | 1668 | −4.7 | −0.28 |
| 19 | 10 | 3.0 | 1756.0 | 1759 | −3.0 | −0.17 |
| 20 | 11 | 3.0 | 1638.6 | 1634 | 4.6 | 0.28 |
| 21 | 12 | 3.0 | 1521.2 | 1521 | 0.2 | 0.01 |
| 22 | 10 | 3.5 | 1613.9 | 1617 | −3.2 | −0.19 |
| 23 | 11 | 3.5 | 1496.5 | 1494 | 2.4 | 0.16 |
| 24 | 12 | 3.5 | 1379.1 | 1381 | −2.0 | −0.14 |

TABLE 5

| No. | Number of winding x (turns) | Base body width y (mm) | Conductor width w (mm) | Actual measurement data (mm) | Difference | Error (%) |
|---|---|---|---|---|---|---|
| 16 | 10 | 2.5 | 0.497 | 0.461 | 0.036 | 7.81 |
| 17 | 11 | 2.5 | 0.450 | 0.432 | 0.018 | 4.17 |
| 18 | 12 | 2.5 | 0.403 | 0.377 | 0.026 | 6.87 |
| 19 | 10 | 3.0 | 0.497 | 0.518 | −0.021 | −4.05 |
| 20 | 11 | 3.0 | 0.450 | 0.472 | −0.022 | −4.66 |
| 21 | 12 | 3.0 | 0.403 | 0.421 | −0.018 | −4.28 |
| 22 | 10 | 3.5 | 0.497 | 0.511 | −0.014 | −2.74 |
| 23 | 11 | 3.5 | 0.450 | 0.446 | 0.004 | 0.90 |
| 24 | 12 | 3.5 | 0.403 | 0.411 | −0.008 | −1.95 |

TABLE 6

| No. | Number of winding x (turns) | Base body width y (mm) | Conductor width w (mm) | Resonant frequency f (MHz) | Conductor width w + 5% | Resonant frequency f (MHz) | Conductor width w − 5% | Resonant frequency f (MHz) | Maximum Error (%) |
|---|---|---|---|---|---|---|---|---|---|
| 16 | 10 | 2.5 | 0.497 | 1898.2 | 0.522 | 1887.2 | 0.472 | 1898.0 | 0.58 |
| 17 | 11 | 2.5 | 0.450 | 1780.8 | 0.473 | 1771.3 | 0.428 | 1779.0 | 0.53 |
| 18 | 12 | 2.5 | 0.403 | 1663.4 | 0.423 | 1659.1 | 0.383 | 1667.6 | 0.26 |
| 19 | 10 | 3.0 | 0.497 | 1756.0 | 0.522 | 1759.1 | 0.472 | 1756.0 | 0.18 |
| 20 | 11 | 3.0 | 0.450 | 1638.6 | 0.473 | 1634.1 | 0.428 | 1630.9 | 0.47 |
| 21 | 12 | 3.0 | 0.403 | 1521.2 | 0.423 | 1520.9 | 0.383 | 1518.4 | 0.18 |
| 22 | 10 | 3.5 | 0.497 | 1613.9 | 0.522 | 1617.3 | 0.472 | 1615.1 | 0.21 |
| 23 | 11 | 3.5 | 0.450 | 1496.5 | 0.473 | 1492.4 | 0.428 | 1493.1 | 0.27 |
| 24 | 12 | 3.5 | 0.403 | 1379.1 | 0.423 | 1380.4 | 0.383 | 1379.4 | 0.10 |

2) In the base body, given that the thickness a is 0.5 mm; the length b is 10 mm; and the relative dielectric constant $\epsilon r$ is 30, then the following equations hold:

$$f=-116.17x-306.67y+3665.2(MHz)$$

$$w=-0.055x+0.957(mm).$$

Figure 9A:
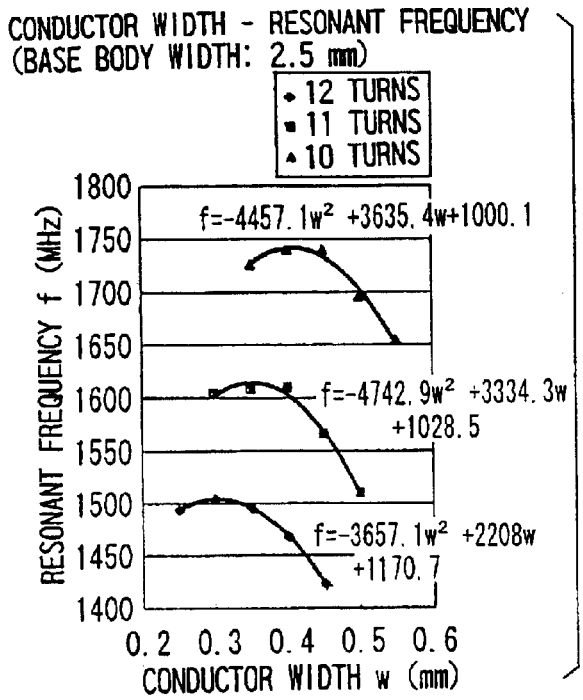
FIGS. 9A through 9C are charts each showing the conductor width—resonant frequency relationship as observed in the helical antenna, on a base body width basis.
Figure 9B:
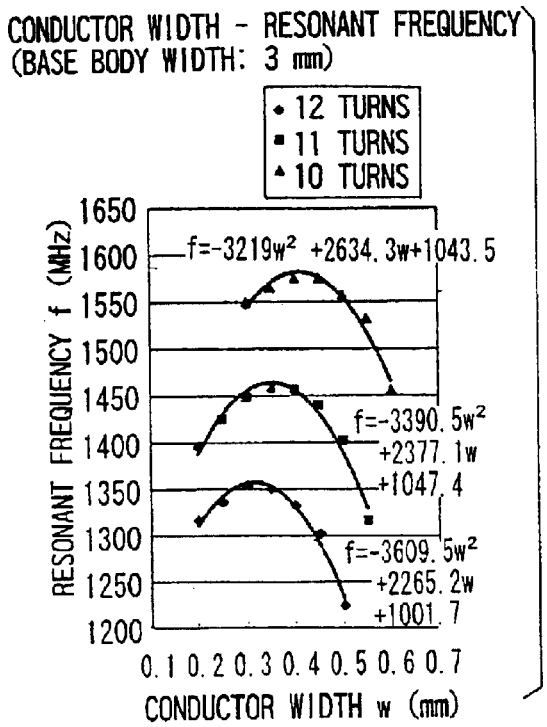
Figure 9C:
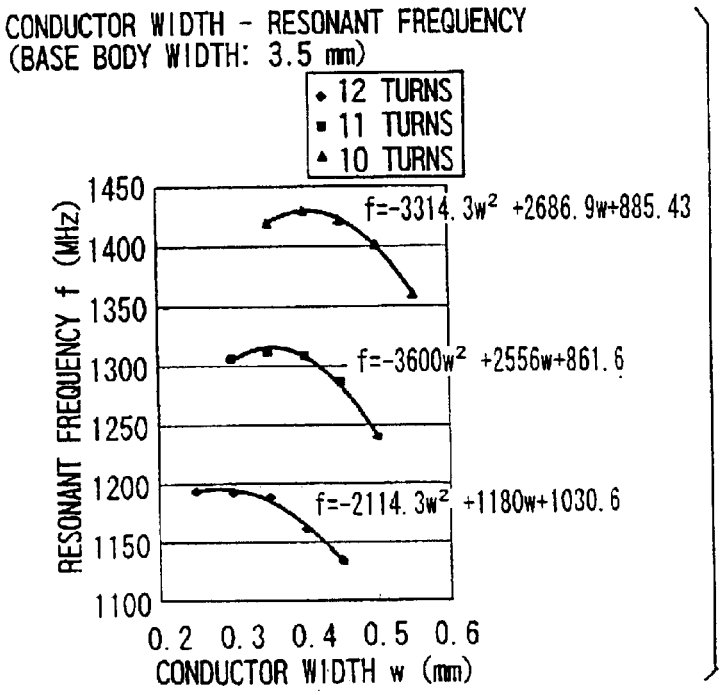
Figure 10A:
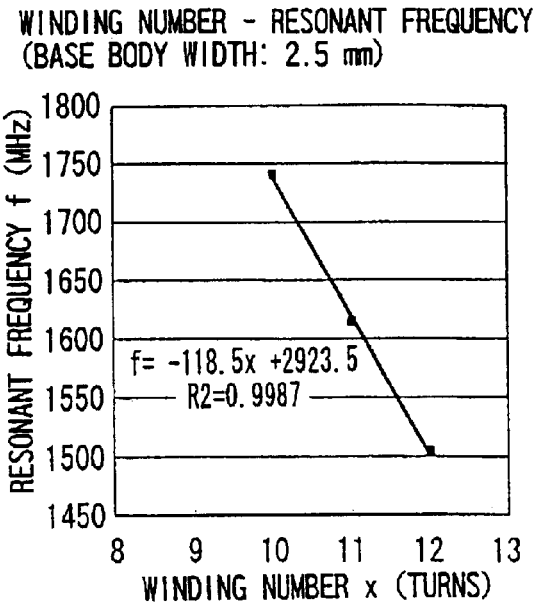
FIGS. 10A through 10C are charts each showing the conductor winding number—resonant frequency relationship as observed in the helical antenna, on a base body width basis.
Figure 10B:
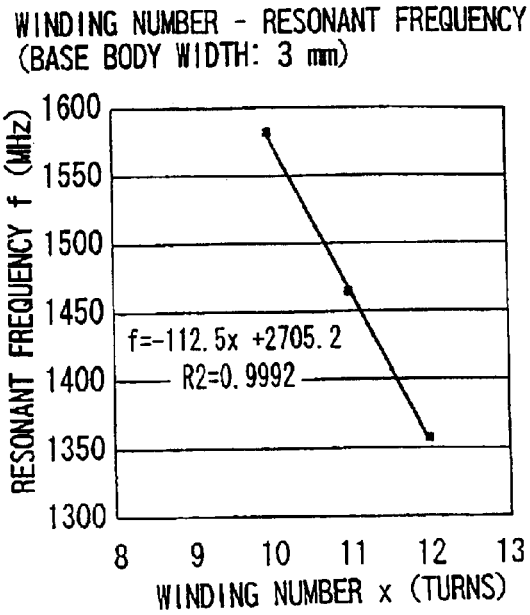
Figure 10C:
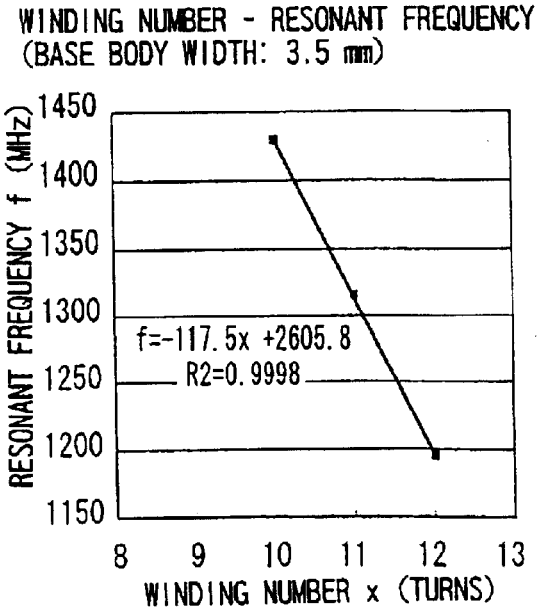
Figure 11A:
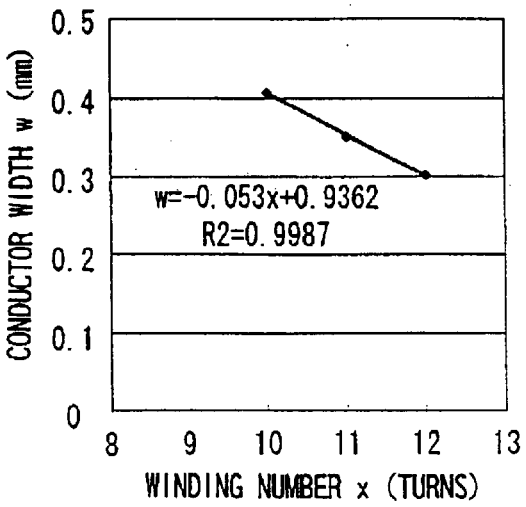
FIGS. 11A through 11C are charts each showing the conductor winding number—conductor width relationship as observed in the helical antenna, on a base body width basis.
Figure 11B:
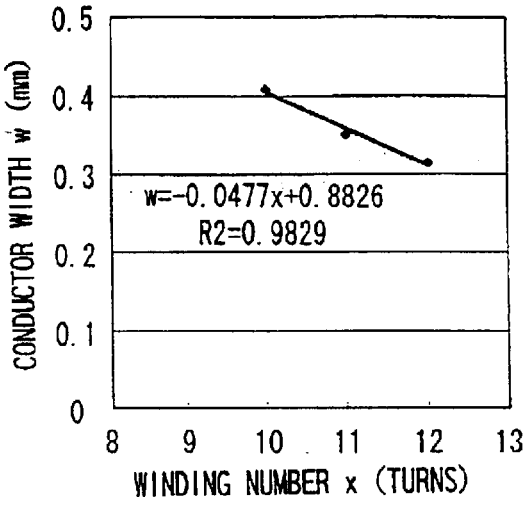
Figure 11C:
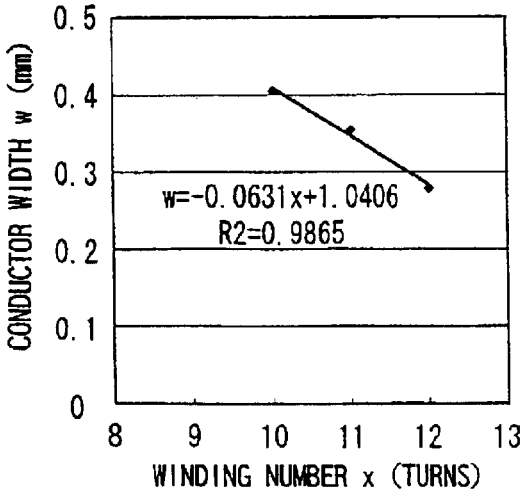

In this case, refer to FIGS. 9A to 9C (conductor width—resonant frequency relationship); FIGS. 10A to 10C (conductor winding number—resonant frequency relationship); and FIGS. 11A to 11C (conductor winding number—conductor width relationship), and in addition Table 7 (calculated results and actual measurement data on resonant frequency); Table 8 (calculated results and actual measurement data on conductor width); and Table 9 (variation of resonant frequency resulting from variation of conductor width).

TABLE 7

| No. | Number of winding x (turns) | Base body width y (mm) | Resonant frequency f (MHz) | Actual measurement data (MHz) | Difference | Error (%) |
|---|---|---|---|---|---|---|
| 25 | 10 | 2.5 | 1736.8 | 1741 | −4.2 | −0.24 |
| 26 | 11 | 2.5 | 1620.7 | 1615 | 5.7 | 0.35 |
| 27 | 12 | 2.5 | 1504.5 | 1504 | 0.5 | 0.03 |
| 28 | 10 | 3.0 | 1583.5 | 1582 | 1.5 | 0.09 |
| 29 | 11 | 3.0 | 1467.3 | 1464 | 3.3 | 0.23 |
| 30 | 12 | 3.0 | 1351.2 | 1357 | −5.9 | −0.43 |
| 31 | 10 | 3.5 | 1430.2 | 1430 | 0.2 | 0.01 |
| 32 | 11 | 3.5 | 1314.0 | 1315 | −1.0 | −0.08 |
| 33 | 12 | 3.5 | 1197.8 | 1195 | 2.8 | 0.24 |

TABLE 8

| No. | Number of winding x (turns) | Base body width y (mm) | Conductor width w (mm) | Actual measurement data (mm) | Difference | Error (%) |
|---|---|---|---|---|---|---|
| 25 | 10 | 2.5 | 0.407 | 0.408 | −0.001 | −0.25 |
| 26 | 11 | 2.5 | 0.352 | 0.352 | 0.000 | 0.00 |
| 27 | 12 | 2.5 | 0.297 | 0.302 | −0.005 | −1.66 |
| 28 | 10 | 3.0 | 0.407 | 0.409 | −0.002 | −0.49 |
| 29 | 11 | 3.0 | 0.352 | 0.351 | 0.001 | 0.28 |

TABLE 8-continued

| No. | Number of winding x (turns) | Base body width y (mm) | Conductor width w (mm) | Actual measurement data (mm) | Difference | Error (%) |
|---|---|---|---|---|---|---|
| 30 | 12 | 3.0 | 0.297 | 0.314 | −0.017 | −5.41 |
| 31 | 10 | 3.5 | 0.407 | 0.405 | 0.002 | 0.49 |
| 32 | 11 | 3.5 | 0.352 | 0.355 | −0.003 | −0.85 |
| 33 | 12 | 3.5 | 0.297 | 0.279 | 0.018 | 6.45 |

TABLE 9

| No. | Number of winding x (turns) | Base body width y (mm) | Conductor width w (mm) | Resonant frequency f (MHz) | Conductor width w + 5% | Resonant frequency f (MHz) | Conductor width w − 5% | Resonant frequency f (MHz) | Maximum Error (%) |
|---|---|---|---|---|---|---|---|---|---|
| 25 | 10 | 2.5 | 0.407 | 1736.8 | 0.427 | 1739.7 | 0.387 | 1739.4 | 0.17 |
| 26 | 11 | 2.5 | 0.352 | 1620.7 | 0.370 | 1613.0 | 0.334 | 1613.1 | 0.47 |
| 27 | 12 | 2.5 | 0.297 | 1504.5 | 0.312 | 1503.6 | 0.282 | 1502.6 | 0.13 |
| 28 | 10 | 3.0 | 0.407 | 1583.5 | 0.427 | 1581.4 | 0.387 | 1580.8 | 0.17 |
| 29 | 11 | 3.0 | 0.352 | 1467.3 | 0.370 | 1462.8 | 0.334 | 1463.2 | 0.31 |
| 30 | 12 | 3.0 | 0.297 | 1351.2 | 0.312 | 1357.1 | 0.282 | 1353.5 | 0.44 |
| 31 | 10 | 3.5 | 0.407 | 1430.2 | 0.427 | 1428.4 | 0.387 | 1428.8 | 0.13 |
| 32 | 11 | 3.5 | 0.352 | 1314.0 | 0.370 | 1314.5 | 0.334 | 1313.8 | 0.04 |
| 33 | 12 | 3.5 | 0.297 | 1197.8 | 0.312 | 1193.0 | 0.282 | 1195.2 | 0.40 |

3) In the base body, given that the thickness a is 0.2 mm; the length b is 20 mm; and the relative dielectric constant $\epsilon r$ is 30, then the following equations hold:

$$f=-51.83x-184y+3139.45(MHz)$$

$$w=-0.102x+2.501(mm).$$

In this case, refer to FIGS. 12A to 12C, 13A to 13C, and 14A to 14C, and in addition Tables 10, 11, and 12.

Figure 12A:
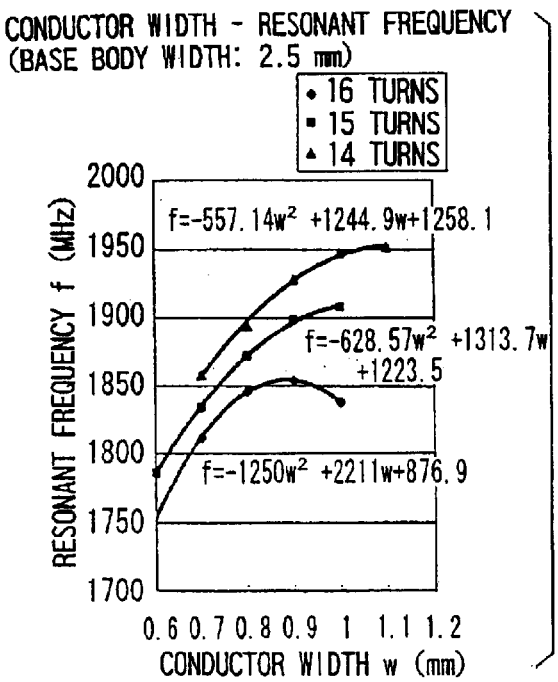
FIGS. 12A through 12C are charts each showing the conductor width—resonant frequency relationship as observed in the helical antenna, on a base body width basis.
Figure 12B:
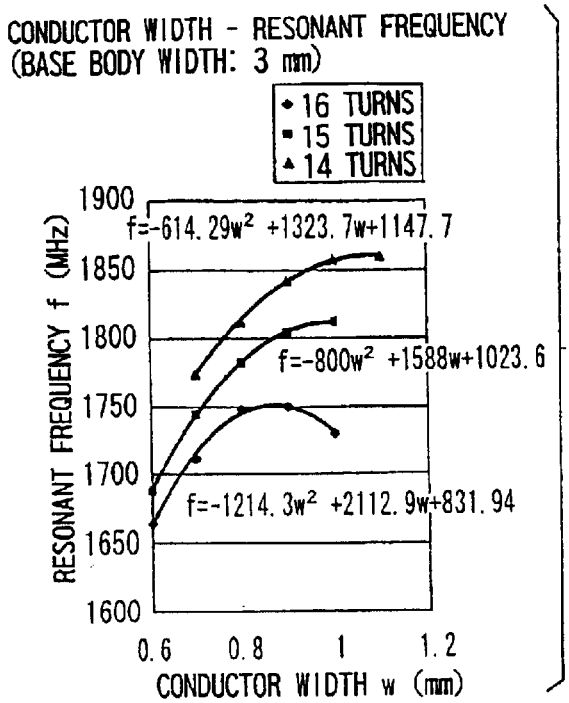
Figure 12C:
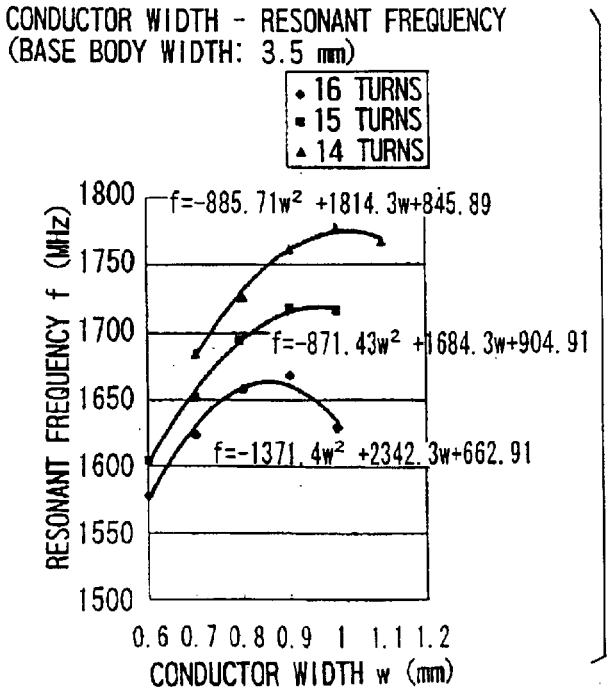
Figure 13A:
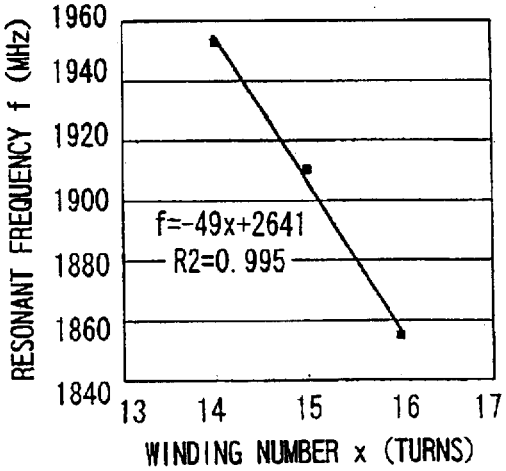
FIGS. 13A through 13C are charts each showing the conductor winding number—resonant frequency relationship as observed in the helical antenna, on a base body width basis.
Figure 13B:
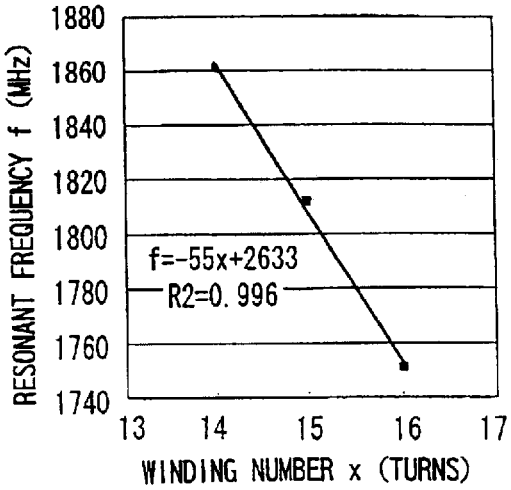
Figure 13C:
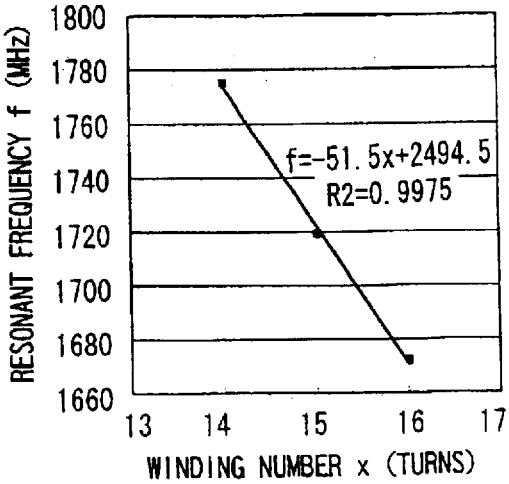
Figure 14A:
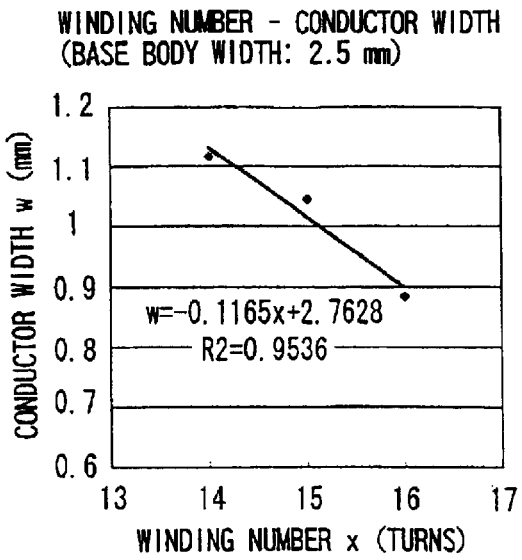
FIGS. 14A through 14C are charts each showing the conductor winding number—conductor width relationship as observed in the helical antenna, on a base body width basis.
Figure 14B:
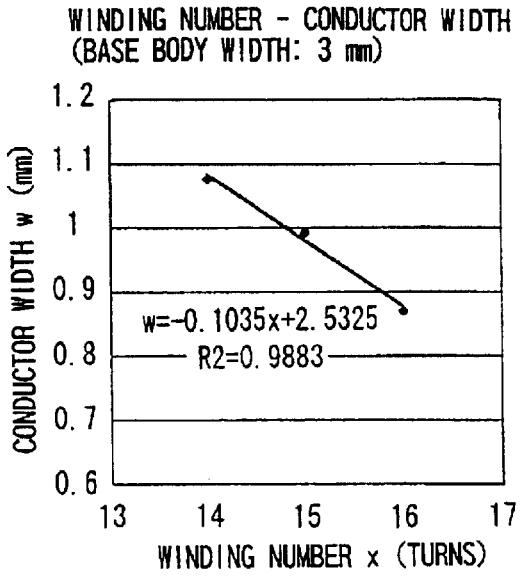
Figure 14C:
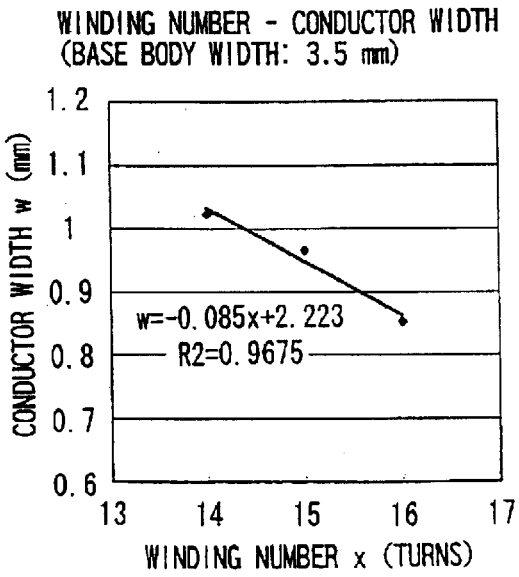

More specifically, refer to FIGS. 12A to 12C (conductor width—resonant frequency relationship); FIGS. 13A to 13C (conductor winding number—resonant frequency relationship); and FIGS. 14A to 14C (conductor winding number—conductor width relationship), and Table 10 (calculated results and actual measurement data on resonant frequency); Table 11 (calculated results and actual measurement data on conductor width); and Table 12 (variation of resonant frequency resulting from variation of conductor width).

TABLE 10

| No. | Number of winding x (turns) | Base body width y (mm) | Resonant frequency f (MHz) | Actual measurement data (MHz) | Difference | Error (%) |
|---|---|---|---|---|---|---|
| 34 | 14 | 2.5 | 1953.8 | 1953 | 0.8 | 0.04 |
| 35 | 15 | 2.5 | 1902.0 | 1910 | −8.0 | −0.42 |
| 36 | 16 | 2.5 | 1850.2 | 1855 | −4.8 | −0.26 |
| 37 | 14 | 3.0 | 1861.8 | 1861 | 0.8 | 0.04 |
| 38 | 15 | 3.0 | 1810.0 | 1812 | −2.0 | −0.11 |
| 39 | 16 | 3.0 | 1758.2 | 1751 | 7.2 | 0.41 |

TABLE 10-continued

| No. | Number of winding x (turns) | Base body width y (mm) | Resonant frequency f (MHz) | Actual measurement data (MHz) | Difference | Error (%) |
|---|---|---|---|---|---|---|
| 40 | 14 | 3.5 | 1769.8 | 1775 | −5.2 | −0.29 |
| 41 | 15 | 3.5 | 1718.0 | 1719 | −1.0 | −0.06 |
| 42 | 16 | 3.5 | 1666.2 | 1672 | −5.8 | −0.35 |

TABLE 11

| No. | Number of winding x (turns) | Base body width y (mm) | Conductor width w (mm) | Actual measurement data (mm) | Difference | Error (%) |
|---|---|---|---|---|---|---|
| 34 | 14 | 2.5 | 1.073 | 1.077 | −0.004 | −0.37 |
| 35 | 15 | 2.5 | 0.971 | 0.993 | −0.022 | −2.22 |
| 36 | 16 | 2.5 | 0.869 | 0.870 | −0.001 | −0.11 |
| 37 | 14 | 3.0 | 1.073 | 1.117 | −0.044 | −3.94 |
| 38 | 15 | 3.0 | 0.971 | 1.045 | −0.074 | −7.08 |
| 39 | 16 | 3.0 | 0.869 | 0.884 | −0.015 | −1.70 |
| 40 | 14 | 3.5 | 1.073 | 1.024 | 0.049 | 4.79 |
| 41 | 15 | 3.5 | 0.971 | 0.966 | 0.005 | 0.52 |
| 42 | 16 | 3.5 | 0.869 | 0.854 | 0.015 | 1.76 |

TABLE 12

| No. | Number of winding x (turns) | Base body width y (mm) | Conductor width w (mm) | Resonant frequency f (MHz) | Conductor width w + 5% | Resonant frequency f (MHz) | Conductor width w − 5% | Resonant frequency f (MHz) | Maximum Error (%) |
|---|---|---|---|---|---|---|---|---|---|
| 34 | 14 | 2.5 | 1.073 | 1953.8 | 1.127 | 1953.5 | 1.019 | 1948.2 | 0.29 |
| 35 | 15 | 2.5 | 0.971 | 1902.0 | 1.020 | 1906.0 | 0.922 | 1896.9 | 0.27 |
| 36 | 16 | 2.5 | 0.869 | 1850.2 | 0.912 | 1853.6 | 0.826 | 1850.3 | 0.19 |
| 37 | 14 | 3.0 | 1.073 | 1861.8 | 1.127 | 1859.3 | 1.019 | 1858.7 | 0.17 |
| 38 | 15 | 3.0 | 0.971 | 1810.0 | 1.020 | 1811.1 | 0.922 | 1807.7 | 0.13 |
| 39 | 16 | 3.0 | 0.869 | 1758.2 | 0.912 | 1748.8 | 0.826 | 1748.6 | 0.54 |
| 40 | 14 | 3.5 | 1.073 | 1769.8 | 1.127 | 1765.7 | 1.019 | 1775.0 | 0.29 |
| 41 | 15 | 3.5 | 0.971 | 1718.0 | 1.020 | 1716.3 | 0.922 | 1717.1 | 0.10 |
| 42 | 16 | 3.5 | 0.869 | 1666.2 | 0.912 | 1658.4 | 0.826 | 1661.9 | 0.47 |

4) In the base body, given that the thickness a is 3 mm; the length b is 5 mm; and the relative dielectric constant εr is 3, then the following equations hold:

$$f=-300.33x-232.33y+3107.38(MHz)$$

$$w=-0.113x+0.681(mm).$$

Figure 15A:
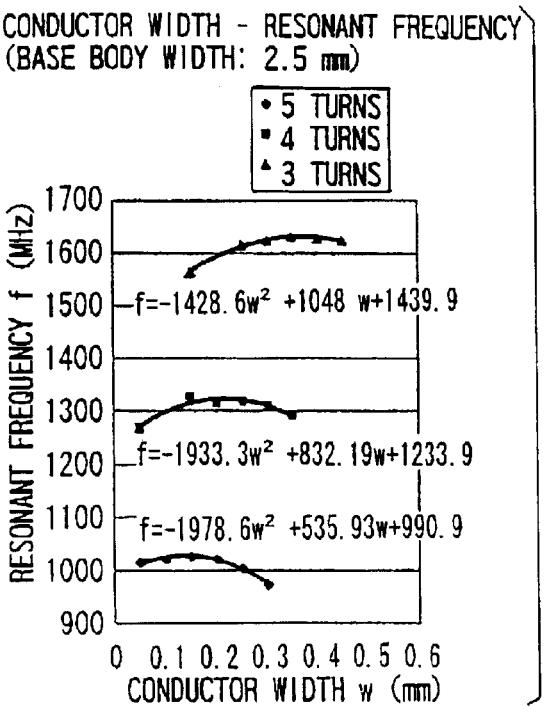
FIGS. 15A through 15C are charts each showing the conductor width—resonant frequency relationship as observed in the helical antenna, on a base body width basis.
Figure 15B:
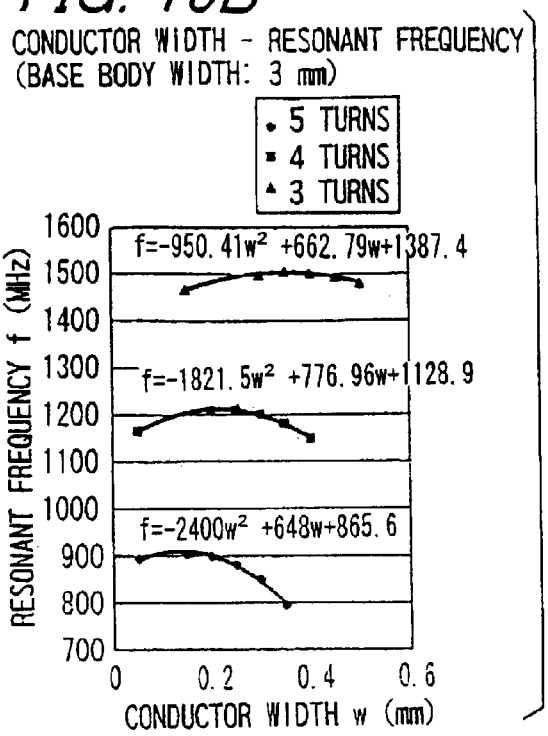
Figure 15C:
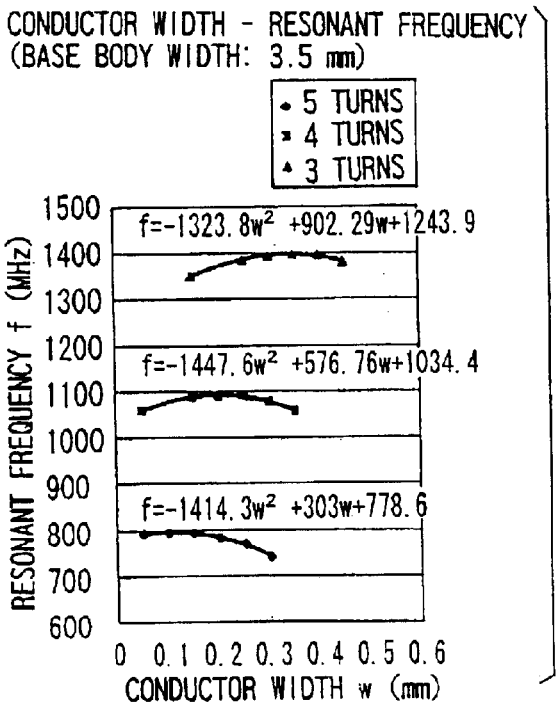
Figure 16A:
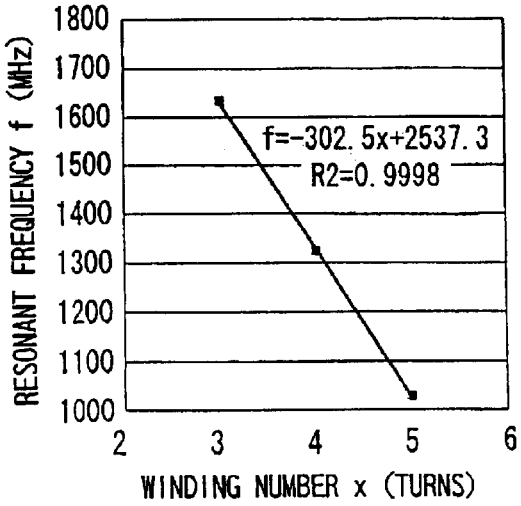
FIGS. 16A through 16C are charts each showing the conductor winding number—resonant frequency relationship as observed in the helical antenna, on a base body width basis.
Figure 16B:
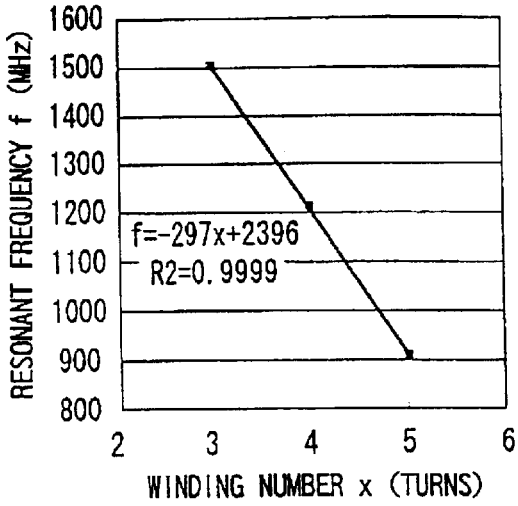
Figure 16C:
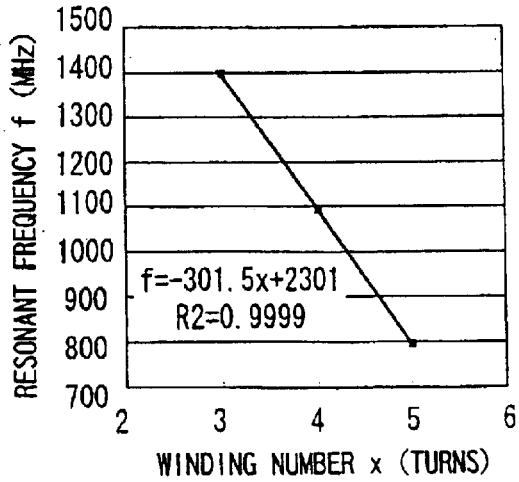
Figure 17A:
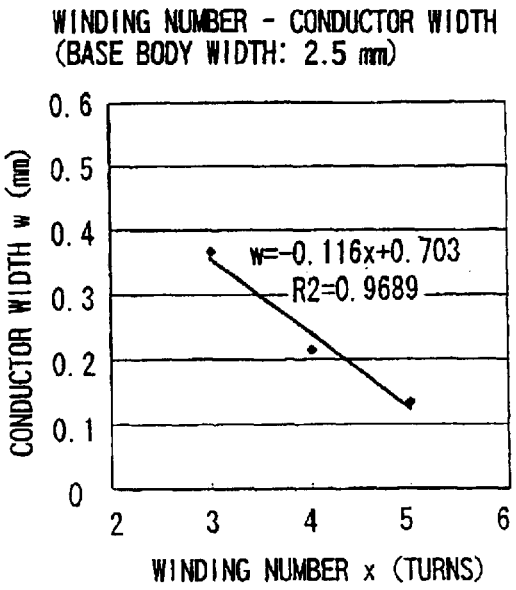
FIGS. 17A through 17C are charts each showing the conductor winding number—conductor width relationship as observed in the helical antenna, on a base body width basis.
Figure 17B:
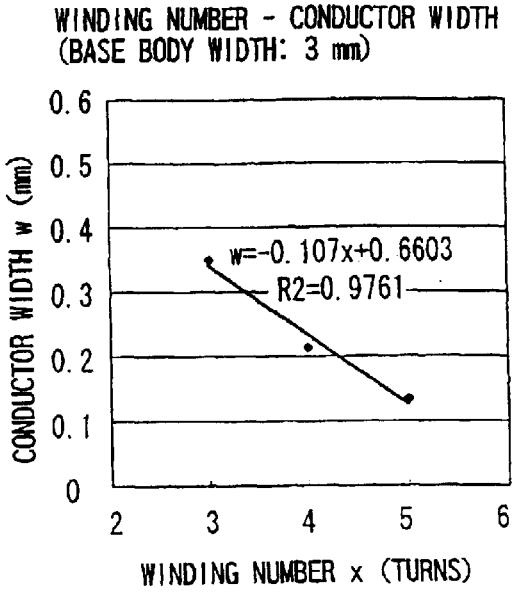
Figure 17C:
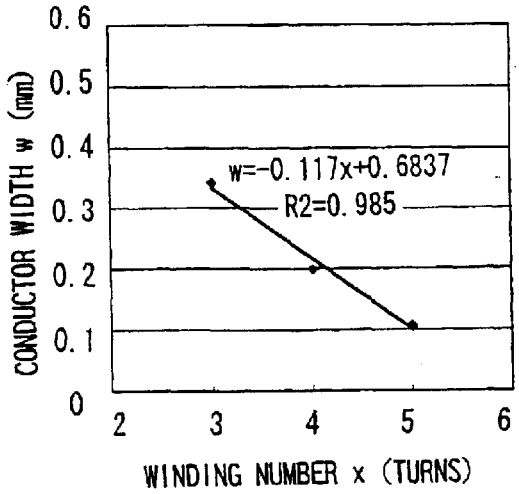
Figure 18:
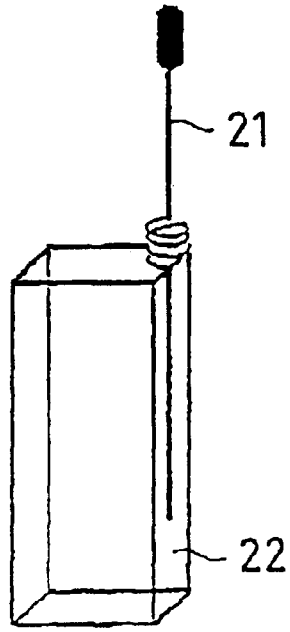
FIG. 18 PRIOR ART
FIG. 18 is a perspective view showing an example of a mobile communication terminal of conventional design.
Figure 19:
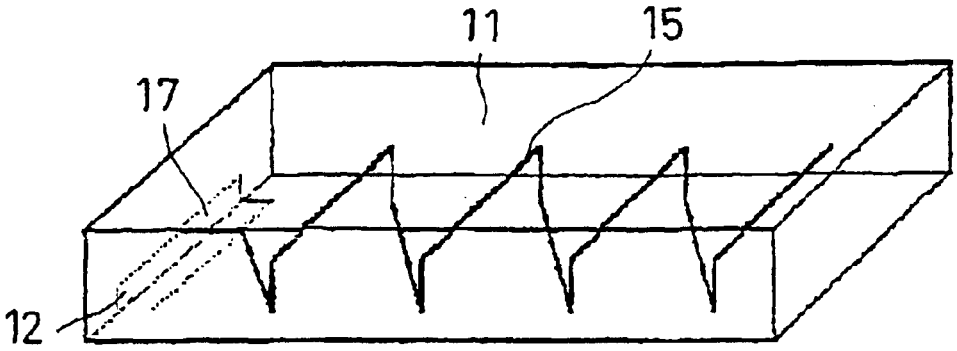
FIG. 19 PRIOR ART
FIG. 19 is a perspective view showing a chip antenna of conventional design.

In this case, refer to FIGS. 15A to 15C (conductor width—resonant frequency relationship); FIGS. 16A to 16C (conductor winding number—resonant frequency relationship); and FIGS. 17A to 17C (conductor winding number—conductor width relationship), and in addition Table 13 (calculated results and actual measurement data on resonant frequency); Table 14 (calculated results and actual measurement data on conductor width); and Table 15 (variation of resonant frequency resulting from variation of conductor width).

TABLE 13

| No. | Number of winding x (turns) | Base body width y (mm) | Resonant frequency f (MHz) | Actual measurement data (mm) | Difference | Error (%) |
|---|---|---|---|---|---|---|
| 43 | 3 | 2.5 | 1625.6 | 1577 | 48.6 | 3.08 |
| 44 | 4 | 2.5 | 1325.2 | 1344 | −18.8 | −1.40 |
| 45 | 5 | 2.5 | 1024.9 | 1033 | −8.1 | −0.78 |
| 46 | 3 | 3.0 | 1509.4 | 1503 | 6.4 | 0.43 |
| 47 | 4 | 3.0 | 1209.1 | 1242 | −32.9 | −2.65 |
| 48 | 5 | 3.0 | 908.7 | 899 | 9.7 | 1.08 |
| 49 | 3 | 3.5 | 1393.2 | 1398 | −4.8 | −0.34 |
| 50 | 4 | 3.5 | 1092.9 | 1122 | −29.1 | −2.59 |
| 51 | 5 | 3.5 | 792.8 | 755 | 37.5 | 4.98 |

TABLE 14

| No. | Number of winding x (turns) | Base body width y (mm) | Conductor width w (mm) | Actual measurement data (mm) | Differ-ence | Error (%) |
|---|---|---|---|---|---|---|
| 43 | 3 | 2.5 | 0.342 | 0.253 | 0.090 | 35.45 |
| 44 | 4 | 2.5 | 0.229 | 0.218 | 0.011 | 4.90 |
| 45 | 5 | 2.5 | 0.116 | 0.136 | −0.020 | −14.71 |
| 46 | 3 | 3.0 | 0.342 | 0.349 | −0.007 | −2.01 |
| 47 | 4 | 3.0 | 0.229 | 0.213 | 0.016 | 7.51 |
| 48 | 5 | 3.0 | 0.116 | 0.135 | −0.019 | −14.07 |
| 49 | 3 | 3.5 | 0.342 | 0.341 | 0.001 | 0.29 |
| 50 | 4 | 3.5 | 0.229 | 0.199 | 0.030 | 14.96 |
| 51 | 5 | 3.5 | 0.116 | 0.107 | 0.009 | 8.31 |

As will be understood from the results set forth hereinabove, in the helical antenna embodying the invention, the thickness a of the base body is kept in a range of 0.3≦a≦3 (mm); the length b of the base body is kept in a range of 5≦b≦20 (mm); and the relative dielectric constant εr of the base body is kept in a range of 3≦εr≦30, and besides the resonant frequency f (MHz) and the conductor width w (mm) are so determined as to satisfy the formulae (1) and (2), respectively. According to the invention, a downsized helical antenna can be designed with ease, and it has been confirmed that, even if there is for example a 5% variation in the conductor width, a variation in the resonant frequency can be reduced to 1% or below.

Example 3

At first, in the helical antenna, the thickness a is set at 0.5 mm; the length b is set at 10 mm; and the relative dielectric constant εr is set at 9.6. for the base body, and the resonant frequency f is set at 1575 MHz (designed for GPS). Next, the width w of the helical antenna's conductor is calculated as follows by means of the equation formulated in Example 1. Note that the number of winding x of the conductor is provisionally set at 11 turns.

$$\begin{aligned} w &= -0.056x + 1.015 \\ &= -0.056 \times 11 + 1.015 \\ &= 0.399 \text{ (mm)}. \end{aligned}$$

As a result of this calculation, the conductor width w has proved to be a numerical value that presents no problem in manufacture. Thus, the number of winding x of the conductor is set at 11 turns, and the conductor width w is set at 0.399 mm.

Subsequently, the width y of the base body is determined by means of the equation formulated in Example 1.

From the equation: f=−125.22x−242.62y+3679.71, the following numerical value is drawn:

$$\begin{aligned} y &= (-125.22x + 3679.71 - f)/242.62 \\ &= (-125.22 \times 11 + 3679.71 - 1575)/242.62 \\ &\approx 3 \text{ (mm)}. \end{aligned}$$

As a result of this calculation, the width y of the base body is given as 3 mm.

TABLE 15

| No. | Number of winding x (turns) | Base body width y (mm) | Conductor width w (mm) | Resonant frequency f (MHz) | Conductor width w + 5% | Resonant frequency f (MHz) | Conductor width w − 5% | Resonant frequency f (MHz) | Maximum Error (%) |
|---|---|---|---|---|---|---|---|---|---|
| 43 | 3 | 2.5 | 0.342 | 1625.6 | 0.359 | 1632.0 | 0.325 | 1629.6 | 0.40 |
| 44 | 4 | 2.5 | 0.229 | 1325.2 | 0.240 | 1322.2 | 0.218 | 1323.4 | 0.23 |
| 45 | 5 | 2.5 | 0.116 | 1024.9 | 0.122 | 1026.8 | 0.110 | 1025.9 | 0.19 |
| 46 | 3 | 3.0 | 0.342 | 1509.4 | 0.359 | 1502.9 | 0.325 | 1502.4 | 0.46 |
| 47 | 4 | 3.0 | 0.229 | 1209.1 | 0.240 | 1210.4 | 0.218 | 1211.7 | 0.22 |
| 48 | 5 | 3.0 | 0.116 | 908.7 | 0.122 | 908.9 | 0.110 | 907.9 | 0.10 |
| 49 | 3 | 3.5 | 0.342 | 1392.2 | 0.359 | 1397.2 | 0.325 | 1397.3 | 0.29 |
| 50 | 4 | 3.5 | 0.229 | 1092.9 | 0.240 | 1089.4 | 0.218 | 1091.4 | 0.32 |
| 51 | 5 | 3.5 | 0.116 | 792.6 | 0.122 | 794.5 | 0.110 | 794.8 | 0.28 |

Example 4

The resonant frequency f is adjusted by changing the base body width y represented in the equation formulated in Example 1.

Under the conditions obtained in Example 3: x=11 turns; y=3 mm; and f=1575 MHz, a variation in the resonant frequency f was examined, provided that the width y of the base body is set at 2.8 mm and 3.2 mm. From the equation formulated in Example 1, the following numerical values are drawn:

$$\begin{aligned} f &= -125.22x - 242.62y + 3679.71 \\ &= -125.22 \times 11 - 242.62y + 3679.71 \\ &= -242.62y + 2302.29, \end{aligned}$$

given y=2.8 mm, f is determined as 1623 MHz, whereas given y=3.2 mm, f is determined as 1526 MHz.

With all things considered, by changing the width y of the base body by 0.2 mm, it is possible to adjust the resonant frequency f by ca. 50 MHz. In other words, by changing the width y of the base body by 0.01 mm, which is defined as the normal adjustment value for the base body width from a production capability standpoint, it is possible to adjust the resonant frequency f by 2.5 MHz, that is, the following relationship holds: 2.5 MHz/0.01 mm. Consequently, it has been confirmed that, by adjusting the base body width y, the resonant frequency f can be adjusted on a 2 to 3 MHz basis.

Example 5

In the helical antenna, the thickness a is set at 0.5 mm; the length b is set at 10 mm; and the relative dielectric constant $\epsilon r$ is set at 9.6 for the base body, and in addition the width w of the conductor is set at 3 mm; the number of winding x of the conductor is set at 11 turns; and the resonant frequency f is set at 1579 MHz. Then, the resonant frequency f is adjusted by changing the width y of the base body.

The base body is grinding-processed by 0.01 mm in the direction of the width y, and simultaneously a conductor pattern having undergone grinding is reconstructed, thereby forming a helical antenna having a base body width y of 2.99 mm. As a result, in the helical antenna, the resonant frequency f can be adjusted to 1581 MHz.

It has been confirmed from the results that the resonant frequency f can be fine-adjusted by adjusting the width y of the base body.

It is to be understood that the application of the invention is not limited to the specific embodiments described heretofore, and that many modifications and variations of the invention are possible within the spirit and scope of the invention. For example, in a case where the base body is formed in the shape of a cylindrical column, by replacing the width y of the base body in the formula (1) with the radius r of the base body, it is possible to expand the applicability of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A helical antenna comprising:

a base body made of a dielectric material or a magnetic material; and a helically-configured conductor formed at least either on a top surface of the base body or in an interior thereof, wherein, in the base body, a thickness a (mm) is kept in a range of $0.3 \leqq a \leqq 3$ (mm); a length b (mm) is kept in a range of $5 \leqq b \leqq 20$ (mm); and a relative dielectric constant $\epsilon r$ is kept in a range of $3 \leqq \epsilon r \leqq 30$ or a relative magnetic permeability $\mu r$ is kept in a range of $1 \leqq \mu r \leqq 8$, and also a number of winding x (turn) of the conductor is kept in a range of $3 \leqq x \leqq 16$, and wherein a resonant frequency f (MHz) and a width w (mm) of the conductor satisfy following formulae (1) and (2), respectively:

$$f = Ax + By + C(MHz) \quad (1)$$

$$w = Dx + E\ (mm) \quad (2)$$

where y represents a width (mm) of the base body; and

A, B, C, D, and E each represent a constant which is determined in accordance with the thickness a, the length b, and the relative dielectric constant $\epsilon r$ or the relative magnetic permeability $\mu r$ of the base body.

2. The helical antenna of claim 1, wherein the base body is made of alumina ceramics or forsterite ceramics.

3. The helical antenna of claim 1, wherein the base body is made of tetrafluoroethylene or glass epoxy.

4. The helical antenna of claim 1, wherein the base body is made of YIG (Yttrium Iron Garnet), Ni—Zr compound or Ni—Co—Fe compound.

5. A communication apparatus comprising a helical antenna including:

a base body made of a dielectric material or a magnetic material; and a helically-configured conductor formed at least either on a top surface of the base body or in an interior thereof, wherein, in the base body of the helical antenna, a thickness a (mm) is kept in a range of $0.3 \leqq a \leqq 3$ (mm); a length b (mm) is kept in a range of $5 \leqq b \leqq 20$ (mm); and a relative dielectric constant $\epsilon r$ is kept in a range of $3 \leqq \epsilon r \leqq 30$ or a relative magnetic permeability $\mu r$ is kept in a range of $1 \leqq \mu r \leqq 8$, and also a number of winding x (turn) of the conductor is kept in a range of $3 \leqq x \leqq 16$, and wherein a resonant frequency f (MHz) and a width w (mm) of the conductor satisfy following formulae (1) and (2), respectively:

$$f = Ax + By + C(MHz) \quad (1)$$

$$w = Dx + E(mm) \quad (2)$$

where y represents a width (mm) of the base body; and

A, B, C, D, and E each represent a constant which is determined in accordance with the thickness a, the length b, and the relative dielectric constant $\epsilon r$ or the relative magnetic permeability $\mu r$ of the base body.

6. The communication apparatus of claim 5, wherein the base body is made of alumina ceramics or forsterite ceramics.

7. The communication apparatus of claim 5, wherein the base body is made of tetrafluoroethylene or glass epoxy.

8. The communication apparatus of claim 5, wherein the base body is made of YIG (Yttrium Iron Garnet), Ni—Zr compound or Ni—Co—Fe compound.

* * * * *